US012642315B2

(12) United States Patent
Luo et al.

(10) Patent No.: US 12,642,315 B2
(45) Date of Patent: Jun. 2, 2026

(54) METHODS, APPARATUSES, AND SYSTEMS FOR PROVIDING PERSONAL PROTECTIVE EQUIPMENT

(71) Applicant: HONEYWELL SAFETY PRODUCTS USA, INC., Charlotte, NC (US)

(72) Inventors: Rui Luo, Shanghai (CN); Jing Xu, Shanghai (CN); Xiaobai Ruan, Shanghai (CN); Menglong Gao, Shanghai (CN); Hongbing Xiang, Shanghai (CN); Yiwei Zhang, Shanghai (CN); Peng Xiang, Shanghai (CN); Yuyan Wang, Shanghai (CN); Bingzhong Xia, Shanghai (CN)

(73) Assignee: Honeywell Safety Products USA, Inc., Latham, NY (US)

( * ) Notice: Subject to any disclaimer, the term of this patent is extended or adjusted under 35 U.S.C. 154(b) by 691 days.

(21) Appl. No.: 17/997,781

(22) PCT Filed: May 15, 2020

(86) PCT No.: PCT/CN2020/090466

§ 371 (c)(1),
(2) Date: Nov. 2, 2022

(87) PCT Pub. No.: WO2021/226992

PCT Pub. Date: Nov. 18, 2021

(65) Prior Publication Data

US 2023/0172291 A1 Jun. 8, 2023

(51) Int. Cl.
*A41D 13/11* (2006.01)

(52) U.S. Cl.
CPC ..... *A41D 13/1161* (2013.01); *A41D 2300/50* (2013.01); *A41D 2500/10* (2013.01)

(58) Field of Classification Search
CPC ..... A41D 13/1161; A41D 2300/50; A41D 2500/10; A41D 13/1138; A41D 27/245;
(Continued)

(56) References Cited

U.S. PATENT DOCUMENTS 11,083,916 B2 * 8/2021 Duffy ..... A41D 13/1115
2001/0032346 A1 10/2001 Matsushita et al.
(Continued)

FOREIGN PATENT DOCUMENTS

CA 2342757 A1 10/2001
CN 2342757 A 10/2001
(Continued)

OTHER PUBLICATIONS

International Search Report and Written Opinion mailed on Feb. 8, 2021 for WO Application No. PCT/CN20/090466.
(Continued)

*Primary Examiner* — Tarla R Patel
(74) *Attorney, Agent, or Firm* — Fredrikson & Byron, P.A.

(57) ABSTRACT

Methods, apparatuses, and systems associated with personal protective equipment are provided. An example mask may include an exterior layer, one or more mask straps coupled to the exterior layer, and a filter layer. An example method for manufacturing a protective garment may include providing a front segment, providing a back segment, and connecting the front segment and the back segment by at least forming a front raglan seam.

9 Claims, 21 Drawing Sheets

(58) Field of Classification Search
CPC .. A41D 31/125; A41D 13/02; A41D 13/1192; A41D 13/129; A41D 31/30; A41D 13/11; A41D 13/05; A41D 13/00; B01D 39/1692; B01D 2239/0233; B01D 2239/0407; B01D 2239/0421; B01D 2239/0428; B01D 39/083; B01D 39/1623; B01D 39/163; B01D 2239/0442; B01D 2239/0622; B01D 2239/065; B01D 2239/0668; B01D 2239/0681; B01D 2239/086; A62B 23/025
See application file for complete search history.

(56) References Cited

U.S. PATENT DOCUMENTS

| | | | | |
|---|---|---|---|---|
| 2010/0098949 | A1 | 4/2010 | Burton et al. | |
| 2011/0315144 | A1* | 12/2011 | Eitzman | A62B 18/025 128/206.19 |
| 2021/0316171 | A1* | 10/2021 | Zhamu | B32B 5/16 |
| 2021/0321697 | A1* | 10/2021 | Schneider | D06M 11/83 |
| 2021/0353979 | A1* | 11/2021 | Lean | A62B 18/086 |
| 2022/0047015 | A1* | 2/2022 | Duffy | A62B 23/025 |
| 2022/0249884 | A1* | 8/2022 | Rathburn | A62B 23/02 |
| 2023/0363475 | A1* | 11/2023 | Facer | A41D 13/11 |

FOREIGN PATENT DOCUMENTS

| | | | | | |
|---|---|---|---|---|---|
| CN | 204561017 | U | | 8/2015 | |
| CN | 104902785 | A | | 9/2015 | |
| CN | 204708049 | U | | 10/2015 | |
| CN | 105559201 | A | * | 5/2016 | A61K 36/185 |
| CN | 105996230 | A | * | 10/2016 | A41D 13/1192 |
| CN | 108741289 | A | * | 11/2018 | A41D 31/02 |
| CN | 108796647 | A | | 11/2018 | |
| CN | 105473192 | B | * | 9/2019 | A41D 13/1161 |
| CN | 209660503 | U | | 11/2019 | |
| CN | 210130376 | U | | 3/2020 | |
| DE | 202020102059 | U1 | * | 4/2020 | A41D 13/113 |
| DE | 202020102578 | U1 | * | 5/2020 | A62B 23/025 |
| EP | 0542491 | A1 | | 5/1993 | |
| EP | 0695763 | A1 | | 2/1996 | |
| EP | 1110948 | A2 | | 6/2001 | |
| EP | 3909449 | A1 | * | 11/2021 | A41D 13/11 |
| EP | 4162828 | A1 | * | 4/2023 | B32B 27/12 |
| IN | 106139442 | A | | 11/2016 | |
| JP | H11172509 | A | | 6/1999 | |
| KR | 101962073 | B1 | * | 3/2019 | A41D 13/1161 |
| KR | 102082969 | B1 | * | 2/2020 | A41D 13/1115 |
| KR | 20200000720 | U | * | 4/2020 | A61M 15/08 |
| KR | 20210110466 | A | * | 9/2021 | A62B 23/025 |
| KR | 20210115161 | A | * | 9/2021 | A41D 5/00 |
| WO | WO-2004008894 | A2 | * | 1/2004 | A41D 13/1146 |
| WO | WO-2021222435 | A1 | * | 11/2021 | A41D 13/0058 |

OTHER PUBLICATIONS

Outgoing—ISA/210—International Search Report Mailed on Feb. 8, 2021 for WO Application No. PCT/CN20/090466.

Yeo, S.Y. et al. "Preparation of nanocomposite fibers for permanent antibacterial effect." Journal of Materials Science, vol. 38. May 31, 2003 (May 31, 2003), 2143-2147.

* cited by examiner

METHODS, APPARATUSES, AND SYSTEMS FOR PROVIDING PERSONAL PROTECTIVE EQUIPMENT

BACKGROUND

Personal protective equipment (PPE) refers to equipment, devices, and/or objects that may be worn by a user to minimize, reduce, and/or eliminate the user's exposure to hazardous, infectious, and/or contagious particulates, substances, materials, and/or environment. For example, an example PPE may protect a wearer from airborne particulate matters (for example, viruses), biohazards, chemical hazards, electrical hazards, physical hazards, and/or other types of environmental hazards.

Existing methods, apparatuses, and systems related to PPE are plagued by challenges and limitations. For example, many apparatuses do not provide sufficient efficacy in protecting a wearer from infection and/or injury caused by hazardous, infectious, and/or contagious particulates, substances, materials, and/or environment.

BRIEF SUMMARY

In accordance with various examples of the present disclosure, various example methods, apparatuses, and systems related to personal protective equipment may be provided.

In some examples, a mask may be provided. The mask may comprise an exterior layer defining an exterior layer breathable area; one or more mask straps coupled to the exterior layer; and a filter layer defining a filter layer breathable area. In some examples, the filter layer may be configured to removably couple to the exterior layer.

In some examples, the exterior layer may define one or more attachment mechanisms configured to hold the filter layer in connection with the exterior layer.

In some examples, the one or more attachment mechanisms may comprise an elastic band attached to the exterior layer, such that the filter layer may be positioned between the elastic band and the exterior layer in an instance the filter layer is coupled to the exterior layer.

In some examples, the exterior layer breathable area and the filter layer breathable area may be configured to at least partially overlap in an instance in which the filter layer is coupled to the exterior layer.

In some examples, the filter layer breathable area may be configured to be positioned on a mouth region of the user in an instance the user is wearing the mask.

In some examples, at least one of the one or more mask straps is adjustable.

In some examples, the one or more mask straps may comprise a first ear strap and a second ear strap. In some examples, the first ear strap may be attached to the exterior layer at one end of the exterior layer and the second ear strap may be attached to the exterior layer at the opposite end of the exterior layer.

In some examples, the exterior layer may comprise a 3-dimensional (3D) knitted, antimicrobial material.

In some examples, the filter layer may replaceable.

In some examples, the exterior layer may comprise a nose clip integral to the exterior layer. In some examples, the nose clip is adjustable.

In some examples, the exterior layer may comprise one or more connection mechanisms. In some examples, at least one of one or more filter layer apertures may be configured to engage with at least one of the one or more connection mechanisms.

In some examples, a method for manufacturing a mask is provided. In some examples, the method may comprise knitting an exterior layer defining an exterior layer breathable area; coupling one or more mask straps to the exterior layer; and providing a filter layer defining a filter layer breathable area.

In some examples, the method further comprises providing one or more attachment mechanisms on the exterior layer. In some examples, the one or more attachment mechanisms may be configured to hold the filter layer in connection with the exterior layer.

In some examples, a nonwoven fiber material for mask may be provided. The nonwoven fiber material may comprise a core comprising base material without antimicrobial treatment; and a sheath surrounding the core. In some examples, the sheath may comprise grafted PHMG.

In some examples, the sheath may comprise at least one of a polypropylene, a polyethylene, or a polyamide grafted with PHMG.

In some examples, the sheath may comprise 20% to 40% of a total weight of the nonwoven fiber material. In some examples, the sheath may comprise 25% to 35% of a total weight of the nonwoven fiber material.

In some examples, the base material of the core may be at least one of a polyester, a polyolefin, or a polyamide.

In some examples, a method for manufacturing a protective garment may be provided. The method may comprise providing a front segment, wherein the front segment may comprise a first raglan edge; providing a back segment, wherein the back segment may comprise a second raglan edge; and connecting the front segment and the back segment by at least forming a front raglan seam joining the first raglan edge and the second raglan edge.

In some examples, the front segment may comprise a first side edge and a front neck opening edge. In some examples, the first raglan edge may connect the first side edge and the front neck opening edge.

In some examples, the front segment may comprise a first arm edge and a second arm edge. In some examples, the method may further comprise forming a first sleeve portion by joining the first arm edge and the second arm edge, wherein the first sleeve portion may comprise a first armhole of the protective garment.

In some examples, the back segment may comprise a third arm edge, a fourth arm edge, and a back neck opening edge. In some examples, the second raglan edge may connect the third arm edge and the back neck opening edge.

In some examples, the method may further comprise forming a second sleeve portion by joining the third arm edge and the fourth arm edge. In some examples, the second sleeve portion may comprise a second armhole of the protective garment.

In some examples, the front segment may comprise a third raglan edge connecting a front neck opening edge of the front segment and a first arm edge of the front segment. In some examples, the back segment may comprise a fourth raglan edge connecting a back neck opening edge of the back segment and a fourth side edge of the back segment.

In some examples, connecting the front segment and the back segment may further comprise forming a back raglan seam joining the third raglan edge and the fourth raglan edge.

In some examples, a method for manufacturing a protective garment may be provided. The method may comprise providing a front segment, wherein the front segment may comprise a first side edge; providing a back segment, wherein the back segment may comprise a second side edge;

connecting the front segment and the back segment by at least forming a first side seam joining the first side edge and the second side edge; and forming a first shirring stitch seam based on the first side seam, wherein the first shirring stitch seam may be shorter than the first side seam.

In some examples, the front segment may comprise a first raglan edge and a front waist edge, wherein the first side edge may connect the first raglan edge and the front waist edge.

In some examples, the back segment may comprise a fourth arm edge and a back waist edge, wherein the second side edge may connect the fourth arm edge and the back waist edge.

In some examples, forming the first shining stitch seam based on the first side seam may further comprise: attaching the first side seam via shining stiches to a first elastic band. In some examples, the first elastic band may be in a stretched state.

In some examples, a length difference between the first shining stitch seam and the first side seam may be within a range between 5 centimeters and 11 centimeters. In some examples, the length difference may be 8 centimeters.

In some examples, the front segment may comprise a third side edge, and the back segment may comprise a fourth side edge. In some examples, the method may further comprise connecting the front segment and the back segment by at least forming a second side seam joining the third side edge and the fourth side edge; and forming a second shining stitch seam based on the second side seam, wherein the second shining stitch seam may be shorter than the second side seam.

In some examples, the front segment may comprise a front waist edge and a second arm edge. In some examples, the third side edge may connect the front waist edge and the second arm edge.

In some examples, the back segment may comprise a fourth raglan edge and a back waist edge. In some examples, the fourth side edge may connect the fourth raglan edge and the back waist edge.

In some examples, forming the second shirring stitch seam based on the second side seam may further comprise: attaching the second side seam via shining stiches to a second elastic band. In some examples, the second elastic band may be in a stretched state.

In some examples, a length difference between the second shining stitch seam and the second side seam may be within a range between 5 centimeters and 11 centimeters. In some examples, the length difference may be 8 centimeters.

In some examples, a method for manufacturing a protective garment may be provided. The method may comprise providing an upper segment, wherein the upper segment may comprise at least one sleeve portion and a first waist edge; providing a lower segment, wherein the lower segment may comprise at least one leg portion and a second waist edge; and connecting the upper segment and the lower segment by at least one detachable fastening mechanism.

In some examples, the at least one detachable fastening mechanism may comprise a zipper fastener. In some examples, the zipper fastener may connect at least a back portion of the first waist edge and at least a back portion of the second waist edge.

In some examples, the zipper fastener may comprise a first teeth row disposed along the first waist edge and a second teeth row disposed along the second waist edge. In some examples, connecting the upper segment and the lower segment may further comprise connecting the first teeth row and the second teeth row via a slider.

In some examples, the at least one detachable fastening mechanism may comprise a hook-and-loop fastener. In some examples, the hook-and-loop fastener may connect at least a back portion of the first waist edge and at least a back portion of the second waist edge.

In some examples, the at least one detachable fastening mechanism may connect at least a back portion of the first waist edge and at least a back portion of the second waist edge. In some examples, the upper segment and the lower segment may be further connected by at least one nondetachable fastening mechanism. In some examples, the at least one nondetachable fastening mechanism may connect at least a front portion of the first waist edge and at least a front portion of the second waist edge.

In some examples, the upper segment may further comprise a flap portion. In some examples, the flap portion may cover at least a portion of the at least one detachable fastening mechanism.

In some examples, a method for manufacturing a protective garment may be provided. The method may comprise providing a lower segment, wherein the lower segment may comprise a first inseam edge and a second inseam edge; and forming at least one leg portion by connecting the first inseam edge and the second inseam edge via at least one detachable fastening mechanism.

In some examples, the at least one detachable fastening mechanism may comprise a zipper fastener. In some examples, the zipper fastener may comprise a first teeth row disposed along the first inseam edge and a second teeth row disposed along the second inseam edge. In some examples, connecting the first inseam edge and the second inseam edge may further comprise connecting the first teeth row and the second teeth row via a slider of the zipper fastener.

In some examples, the at least one detachable fastening mechanism may comprise a hook-and-loop fastener.

In some examples, the method may further comprise forming two leg portions by connecting the first inseam edge and the second inseam edge via the at least one detachable fastening mechanism.

In some examples, a material may be provided. The material may comprise a vapor transfer layer comprising hydrophobic material; a vapor venting layer disposed on top of the vapor transfer layer; a water absorption layer disposed on top of the vapor venting layer, the water absorption layer comprising water absorption material; and a coating layer disposed on top of the water absorption layer, the coating layer comprising antimicrobial material.

In some examples, the hydrophobic material of the vapor transfer layer may comprise at least one of polypropylene nonwoven fabric or polyethylene nonwoven fabric.

In some examples, the vapor venting layer may comprise hydrophilic material.

In some examples, the water absorption layer may comprise polyacrylic particles.

In some examples, the coating layer may comprise at least one of silver ions, silver zeolite, silver zinc zeolite, silver copper zeolite, silver $SiO_2$, zinc pyrithione, quaternary ammonium compound, or guanidine compound.

The foregoing illustrative summary, as well as other exemplary objectives and/or advantages of the disclosure, and the manner in which the same are accomplished, are further explained in the following detailed description and its accompanying drawings.

BRIEF DESCRIPTION OF THE DRAWINGS

The description of the illustrative examples may be read in conjunction with the accompanying figures. It will be appreciated that, for simplicity and clarity of illustration, components and elements illustrated in the figures have not necessarily been drawn to scale, unless described otherwise. For example, the dimensions of some of the components or elements may be exaggerated relative to other elements, unless described otherwise. Examples incorporating teachings of the present disclosure are shown and described with respect to the figures presented herein, in which.

DETAILED DESCRIPTION OF THE INVENTION

Figure 1A:
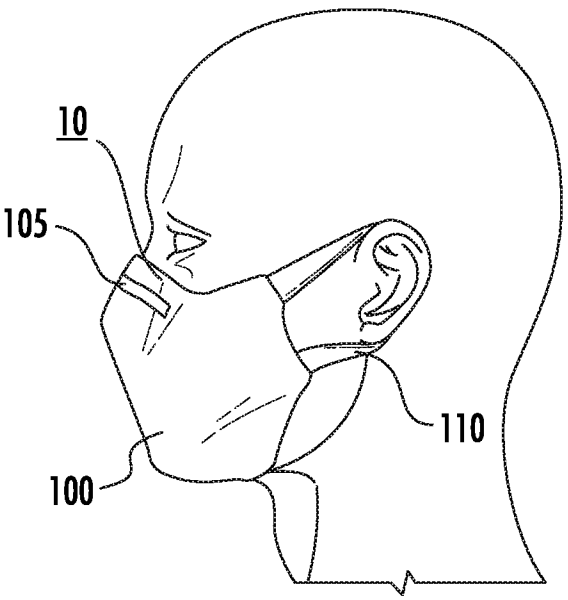
FIG. 1A, FIG. 1B and FIG. 1C illustrate various example views of an example mask of an example embodiment worn by a user in accordance with examples of the present disclosure.

Some examples of the present disclosure will now be described more fully hereinafter with reference to the accompanying drawings, in which some, but not all examples of the disclosure are shown. Indeed, these disclosures may be embodied in many different forms and should not be construed as limited to the examples set forth herein; rather, these examples are provided so that this disclosure will satisfy applicable legal requirements. Like numbers refer to like elements throughout.

The phrases "in one example," "according to one example," "in some examples," and the like generally mean that the particular feature, structure, or characteristic following the phrase may be included in at least one example of the present disclosure and may be included in more than one example of the present disclosure (importantly, such phrases do not necessarily refer to the same example).

If the specification states a component or feature "may," "can," "could," "should," "would," "preferably," "possibly," "typically," "optionally," "for example," "as an example," "in some examples," "often," or "might" (or other such language) be included or have a characteristic, that specific component or feature is not required to be included or to have the characteristic. Such component or feature may be optionally included in some examples, or it may be excluded.

The word "example" or "exemplary" is used herein to mean "serving as an example, instance, or illustration." Any implementation described herein as "exemplary" is not necessarily to be construed as preferred or advantageous over other implementations.

As described above, PPE may protect a wearer from infection and/or injury caused by hazardous, infectious, and/or contagious particulates, substances, materials, and/or environment. Example PPE may include, but not limited to, masks (for example, face masks, surgical masks), respirators, face shields, protective clothing (for example, protective garment), protective hearing devices (for example, earplugs, muffs), protective headgear (for example, helmets, hard hats), protective footwear (for example, safety shoes), protective eyewear (for example, goggles), and/or the like.

As discussed herein, examples of PPE of the present disclosure may be described with reference to a fiber structure that includes various cores, filaments, yarns, coverings, and the like. In this regard, the fiber structure as described and claimed may, in some examples, refer to a composite fiber structure. For the sake of clarity of description, example embodiments of the present application are herein described with reference to an "antimicrobial fiber", but may equally and interchangeably refer to composite antimicrobial fiber structures. The term antimicrobial may indicate a substantial reduction in microorganisms, may indicate a complete reduction and/or elimination of microorganisms, may indicate a fiber that is active against microorganisms, and/or the like.

In accordance with various examples of the present disclosure, a mask may be provided. The mask of various embodiments may allow for a comfortable fitting. For example, examples of the present disclosure may provide an antimicrobial mask with a multi-layered design to allow for reusability and/or breathability.

For example, the mask discussed herein may have two layers: an exterior layer and a filter layer, which are operably coupled together to allow for increased performance. In various embodiments, the filter layer may be removable and disposable, such that the filter layer may be removed from the exterior layer and a new filter layer may be attached to the exterior layer. As such, an example mask discussed herein may allow for a similar or improved filtration rate compared to disposable mask and an improved filtration rate compared to individual textile masks (e.g., cloth masks). As such, the mask of various embodiments allows for the benefits of a mask (e.g., at least the exterior layer is reusable in an example embodiment) with the filtration rate of a disposable mask.

While the description above provides an example of mask having two layers, it is noted that the scope of the present disclosure is not limited to the description above. In some examples, an example mask may comprise more than two or less than two layers. For example, an example mask may comprise more than one filter layer. As another example, an example mask may only comprise the exterior layer.

Figure 1B:
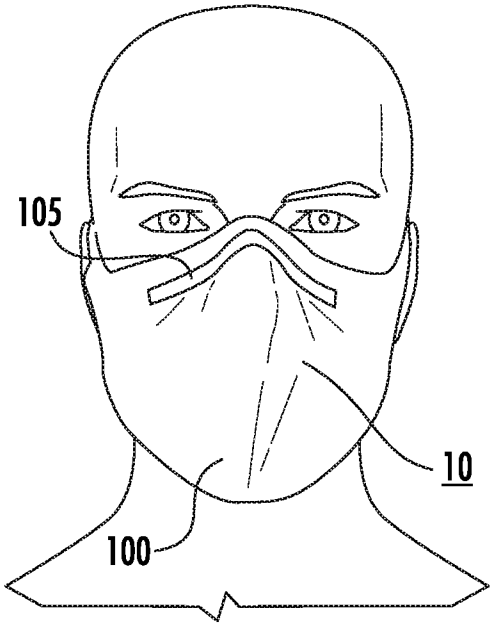
Figure 1C:
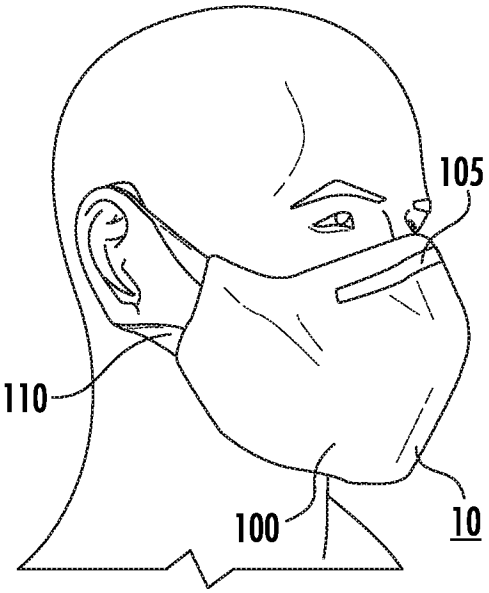

FIGS. 1A-1C are various views of a mask in accordance with an example embodiment of the present disclosure. An example mask 10 may include an exterior layer 100, a filter layer 200 (shown in FIGS. 2D-2G), and one or more mask straps 110.

In various embodiments, the one or more layers of the mask 10 may, in some examples, include antimicrobial characteristics. In various embodiments, one or more layers of the mask 10 may be reusable (e.g., the exterior layer 100 of the mask 10). In various embodiments, the exterior layer 100 of the mask 10 may be, in some examples, ergonomically shaped to fit to the face of a user. For example, the exterior layer 100 of the mask 10 may be formed via a 3-dimensional (3D) knitting process. As used herein, the term "3D knitting" or "3D knitting process" refers to a manufacturing method that may produce a three dimensional product (for example, mask, clothing, garment) as one single piece. For example, the 3D knitting process may be implemented by an 3D knitting machine. The 3D knitting machine may receive one or more digital files that may provide specification(s) of the product (for example, a shape, size, and/or pattern of the exterior layer 100 of the mask 10), and may receive raw material (for example, fiber material). Based on the digital file(s) and the raw material, the 3D knitting machine may produce the exterior layer 100 of the mask 10 according to the digital file (for example, through melt spinning or wet spinning to form the nonwoven material for the exterior layer 100 of the mask 10).

For example, the exterior layer 100 of the mask 10 may be configured to contour approximately around the face of a user when donned. As such, the exterior layer 100 may fit around the chin on the bottom portion of the exterior layer and around the nose on the upper portion.

In some examples, the area of the exterior layer 100 that is configured to be positioned over a mouth region of a user when donned may be configured to provide a gap between the mouth and the mask, such that the user is able to breath more easily. For example, during the 3D knitting process, the 3D knitting machine may form the area of the exterior layer 100 based on the contour of the mouth region of the user. In various embodiments, the exterior layer 100 of the mask 10 may be configured to seal with the user's face when donned, such that little to no air passes underneath the mask. For example, the 3D shape of the mask 10 may allow little to no air to pass between the mask and the user's face. In various embodiments, the exterior layer 100 may be shaped using various other manufacturing methods, such as sewing and/or heat molding.

In some examples, the area of the exterior layer 100 that is configured to be positioned over a mouth region of a user when donned may comprise a breathable area. As used herein, the term "breathable area" refers to an area of a material (for example, nonwoven material) where hollow portions between fibers of the material is larger than hollow portions between fibers of the material surrounding the breathable area. As such, the breathability of the breathable area may be improved, and a user may more easily breathe through the breathable area. In some examples, the breathable area of the exterior layer 100 may be produced by the 3D knitting machine. For example, the 3D knitting machine may receive a digital file that defines the location of the breathable area, and may form webs using the raw materials received in the breathable area with larger hollow portions. As such, the exterior layer may define an exterior layer breathable area. For example, the exterior layer breathable area may comprise hollow portions between fibers of the exterior layer that allows for increased breathability.

Additionally, or alternatively, the filter layer may define a filter layer breathable area. For example, the filter layer breathable area may comprise hollow portions between fibers of the filter layer that allow for increased breathability. The formation of the filter layer breathable area may be implemented in a similar 3D-knitting process as described above in connection with the exterior layer breathable area.

While the description above provides example processes of forming the exterior layer breathable area and the filter layer breathable area, it is noted that the scope of the present disclosure is not limited to the description above. For example, the exterior layer breathable area and/or the filter layer breathable area may be formed based on one or more other example processes described herein.

While the description above provides an example method of manufacturing the exterior layer 100 of the mask 10, it is noted that the scope of the present disclosure is not limited to the description above. In some examples, an example method of manufacturing may comprise one or more additional and/or alternative step(s) and/or technique(s). For example, a heated molding process may be applied on raw nonwoven material to form the exterior layer 100 of the mask 10.

Referring back to FIG. 1A-FIG. 1C, the exterior layer 100 may include a nose clip 105 configured to allow the exterior layer 100 to be adjusted. In various embodiments, the nose clip 105 may be adjustable. For example, the nose clip 105 may comprise material having adjustable characteristic, including but not limited to, metal (e.g. aluminum), plastic (e.g. polyethylene or polythene), and/or metal with plastic coating. In various embodiments, the nose clip 105 may be a composite material. For example, the nose clip 105 may be a composite plastic strip with an internal material (e.g., stainless steel wire). In various embodiments, the nose clip 105 may be configured to be adjusted based on the nose of a user.

In various embodiments, the nose clip 105 may be integral to the exterior layer 100. For example, the nose clip 105 may be knit-embedded into the exterior layer 100 during the 3D knitting process. In various embodiments, the exterior layer 100 may have a pocket knitted and configured to receive the nose clip 105 to form an integral exterior layer 100. In some examples, an outer surface of the exterior layer 100 may comprise a colored region that may correspond to the region where the nose clip 150 is embedded, and the colored region may have a color (for example, red) different from a color (for example, blue) of surrounding regions on the outer surface of the exterior layer 100. As such, the user may be made aware of the nose clip 150 due to the color difference.

In various embodiments, the one or more layers of the mask 10 may implement and/or otherwise be composed of an example antimicrobial fiber. For example, the exterior layer 100 may be manufactured or otherwise formed of antimicrobial fiber manufactured in line with one or more example embodiments discussed herein. For example, the antimicrobial fiber may be used to create a nonwoven material used in various embodiments of the present disclosure.

Figure 2A:
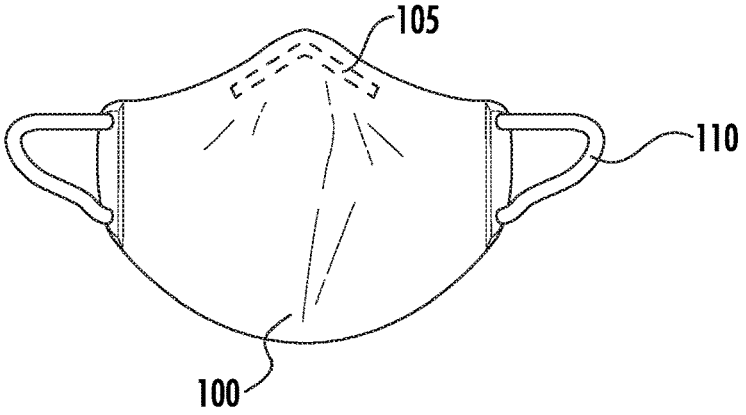
FIG. 2A illustrates an example exterior layer of an example mask in accordance with examples of the present disclosure.

FIG. 2A is the exterior layer of the mask in accordance with an example embodiment. In various embodiments, the exterior layer 100 of the mask 10 may be formed via a 3D knitting process, similar to those described above. In various embodiments, the exterior layer 100 may include an antimicrobial material. Example embodiments described herein illustrate an exterior layer 100 of the mask 10 that, in some example embodiments, is knitted seamlessly using a 3D knitting process. In some examples, the exterior layer 100 may therefore be manufactured as one single piece. In various embodiments, the exterior layer 100 may be shaped during the manufacturing process to fit on the face of a user.

In various embodiments, the exterior layer 100 may be stretchable in at least one of the weft or warp direction (e.g., to allow for a better fit for a user in an example embodiment). For example, a user may apply force in the weft or warp direction on the exterior layer 100 to further adjust the shape of the exterior layer 100. In some examples, stretchable or extensible nonwoven material may be used. In various embodiments, one direction may be more stretchable than the other (e.g., the vertical direction may be more stretchable than the horizontal direction).

In various embodiments, the exterior layer 100 may be reusable (e.g., the exterior layer 100 may be machine washable or the like). As discussed in more detail below in reference to FIG. 3, one or more mask straps 110 may be attached to the exterior layer 100 of the mask 10. In various embodiments, the one or more mask straps 110 may be a plurality of ear straps (e.g., as shown) or a head strap (e.g., a singular strap extending from one side of the exterior layer 100 to the other side and configured to fit around the head of a user).

Figure 2B:
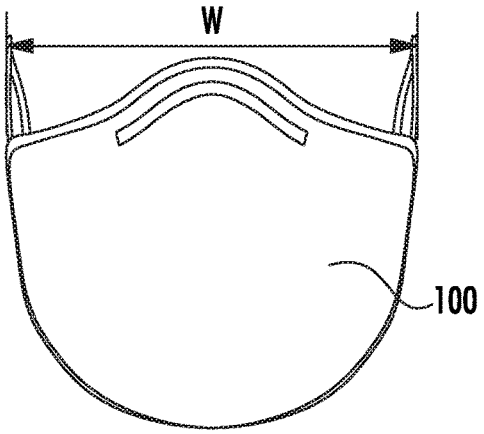
FIG. 2B illustrates a frontal view of another example exterior layer of an example mask in accordance with examples of the present disclosure.
Figure 2C:
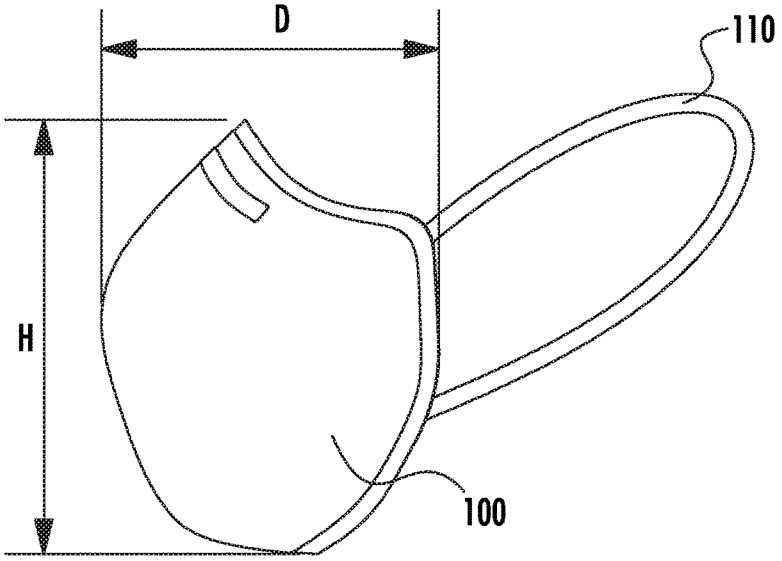
FIG. 2C illustrates a side view of the example exterior layer shown in FIG. 2B in accordance with examples of the present disclosure.

FIGS. 2B and 2C illustrate a front view (FIG. 2B) and a side view (FIG. 2C) of an exterior layer 100 of an example embodiment. As shown, the exterior layer 100 may define a width (W), depth (D), and a height (H). In various embodiments, the width of the exterior layer 100 (shown in FIG. 2B) may be approximately the width of a user's face. In various embodiments, the width (W) of the exterior layer 100 may be at least the width of an expected user's mouth, such that the exterior layer 100 is configured to cover the mouth of a user when donned. For example, the width (W) may be between 120 millimeters and 130 millimeters. In some examples, the width (W) may be 126.63 millimeters.

In various embodiments, the height (H) of the exterior layer 100 may be at least the distance from the approximate nose of a user to below the mouth of a user (e.g., under the chin of the user). For example, the height (H) may be between 110 millimeters and 120 millimeters. In some examples, the height (H) may be 114.15 millimeters.

In various embodiments, the depth (D) of the exterior layer 100 may provide a distance between a user's mouth and the mask, such that the user, in some examples, is more able to breath freely while using the mask. For example, the depth (D) may be between 80 millimeters and 90 millimeters. In some examples, the depth (D) may be 88.7 millimeters.

In various embodiments, the distances discussed herein may be based on the size of the intended user. For example, different sized masks may be produced with the same shape and functionality.

Figure 2D:
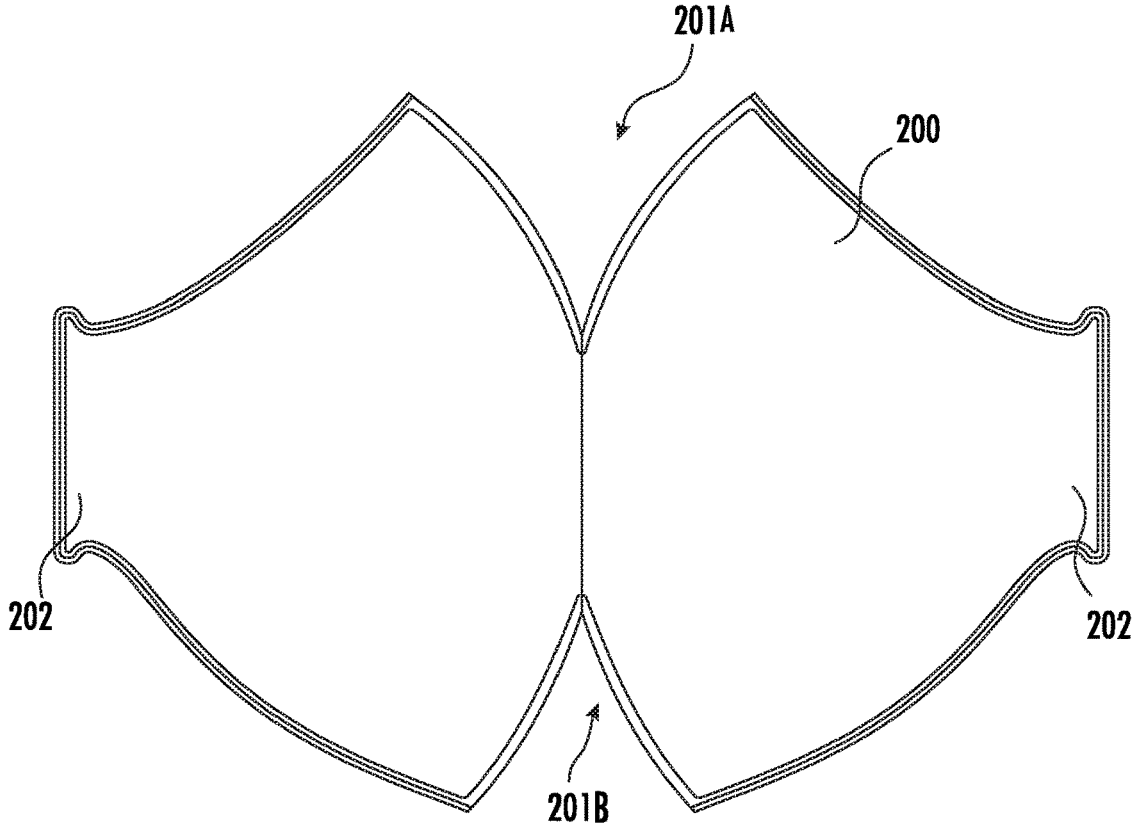
FIG. 2D is a two-dimensional view of an example filter layer of an example mask in accordance with examples of the present disclosure.
Figure 2E:
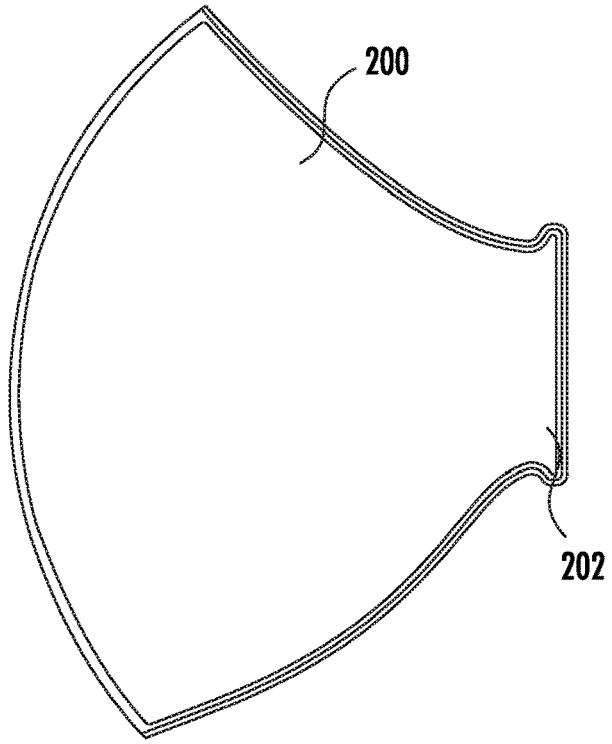
FIG. 2E is a side view of an example filter layer of an example mask in accordance with examples of the present disclosure.
Figure 2F:
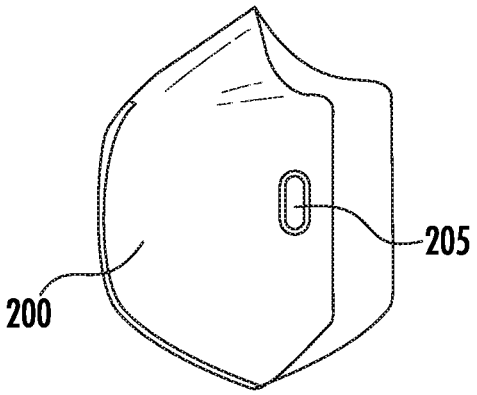
FIG. 2F illustrates an example view of an example filter layer of an example mask in accordance with examples of the present disclosure.

FIGS. 2D-2F are example filter layers of the mask in accordance with an example embodiment. In various embodiments, the filter layer 200 may comprise a disposable filter material that may be configured to be replaced. For example, the disposable filter material may comprise nonwoven polypropylene fiber. In various embodiments, the filter layer 200 may comprise a traditional material used for filtration masks, such as spunbond meltblown spunbond (SMS). For example, the filter layer 200 may be a low breathability resistance melt blow material.

FIG. 2D illustrates a 2-dimensional view of an example filter layer 200 in accordance with various embodiments. As shown, the filter layer 200 may be configured with one or more slits 201A, 201B configured to allow the filter layer 200 to conform to the shape of the exterior layer 100 (e.g., in an instance in which the filter layer 200 is a flat filter discussed herein).

In some examples, the slits 201A, 201B may allow the example filter layer 200 to form a 3D shape. For example, one side of the slit line of the slit 201A may be connected and/or attached to the other side of the slit line of the slit 201A. Additionally, or alternatively, one side of the slit line of the slit 201B may be connected and/or attached to the other side of the slit line of the slit 201B. FIG. 2E shows the filter layer 200 shaped into a 3D shape in an example embodiment.

In various embodiments, the filter layer 200 may have a width between 190 millimeters and 200 millimeters. In some examples, the filter layer 200 may have a width of 195 millimeters. In various embodiments, the filter layer 200 may have a height between 130 millimeters and 140 millimeters. In some examples, the filter layer 200 may have a height of 133 millimeters. In various embodiments, the filter layer 200 may have similar, yet smaller dimensions as the exterior layer 100, such that the filter layer 200 may fill up the inside of the exterior layer 100 when coupled. In various embodiments, the filter layer 200 may be smaller than the exterior layer 100, such that the filter layer 200 does not interfere with the sealing of the exterior layer 100 to the user's face during operation.

In various embodiments, the filter layer 200 may be generally shaped similar to the exterior layer 100, such that the filter layer 200 may conform to the exterior layer 100 in an instance in which the filter layer 200 is coupled to the exterior layer 100. In various embodiments, the filter layer 200 may be a foldable flat material that may conform to the shape of the exterior layer 100 instead of being formed independently (e.g. the filter layer 200 may take the shape of exterior layer 100).

In various embodiments, the filter layer 200 may include one or more filter layer apertures 205 configured to engage with one or more connection mechanisms provided on the exterior layer (e.g., the filter layer 200 may click into position coupled to the exterior layer 100). As shown in FIG. 2F, the filter layer apertures 205 may be defined generally at opposing ends of the filter layer 200, such that in an instance each of the filter layer apertures 205 are engaged with a given connection mechanism, the filter layer apertures 205 may be sufficiently coupled to the exterior layer 100. As such, the filter layer apertures 205 may cause the filter layer 200 to be coupled to the exterior layer 100 (for example, an inner surface of the exterior layer 100) and be in contact with a wearer.

For example, the connection mechanism may comprise a snap mechanism. In this example, an inner surface of the exterior layer 100 may comprise one or more protrusions that may be located corresponding to the locations of the filter layer apertures 205 of the filter layer 200. The protrusions may temporarily deflect to catch the filter layer apertures 205, and may then spring back to the original unstressed state, such that the filter layer 200 may be securely fastened to the exterior layer 100.

Figure 5A:
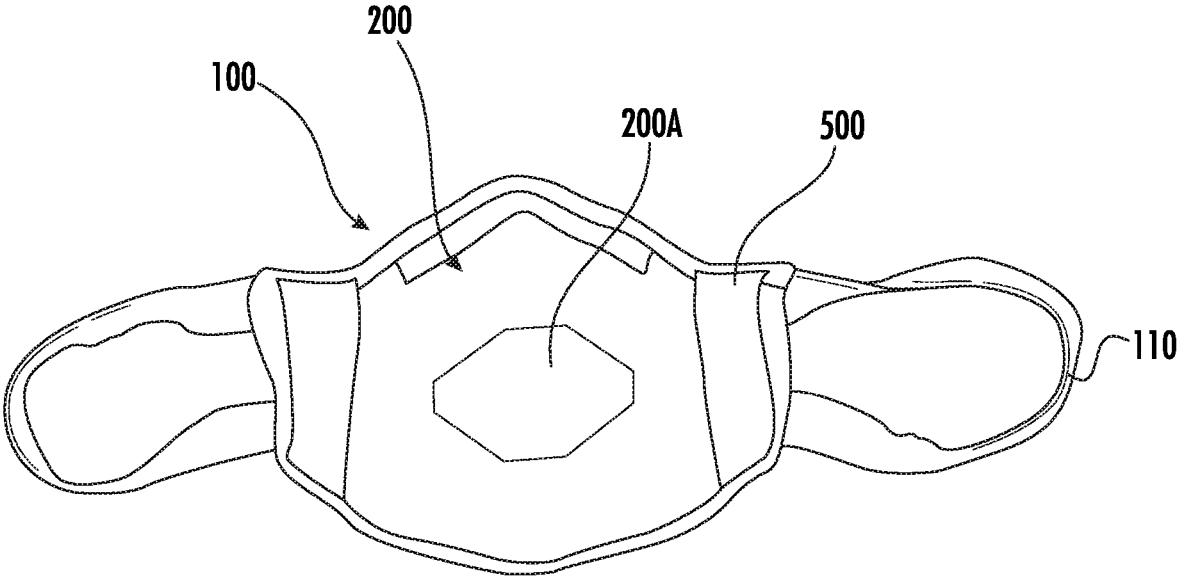
FIG. 5A and FIG. 5B illustrate an example attachment mechanism used to attach an example filter layer to an example exterior layer of an example mask in accordance with examples of the present disclosure.
Figure 5B:
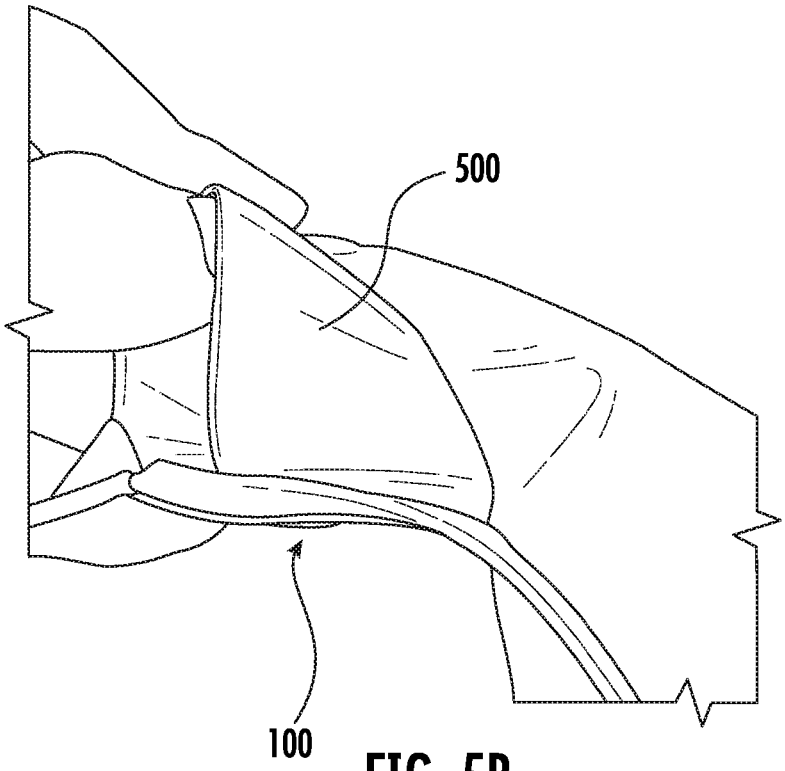

As shown in FIG. 2D and FIG. 2E, the filter layer 200, in various embodiments, may be configured with one or more attachment protrusions 202 configured to be received by the attachment mechanism 500 discussed in FIGS. 5A and 5B. In various embodiments, the filter layer 200 may be shaped such that the attachment protrusions 202 may be capable of passing through the attachment mechanism 500 (e.g., underneath the attachment mechanism 500 in the form of an elastic band shown in FIG. 5B). In various embodiments, the attachment protrusion 202 may be in place of or in addition to other methods of attachment (e.g., the filter layer aperture 205 shown in FIG. 2F).

In various embodiments, the number and position of the filter layer apertures 205 may vary. For example, more than two filter layer apertures may be provided around the edge of the filter layer 200 to provide additional coupling force with the exterior layer 100.

While the description above provides an example connection mechanism, it is noted that the scope of the present disclosure is not limited to the description above. In some examples, an example connection mechanism may comprise one or more additional and/or alternative elements. For example, the filter layer 200 and the exterior layer 100 may be connected through hook-and-loop mechanism (for example, through Velcro straps).

In various embodiments, similar to those described above and will be discussed in more detail in reference to FIGS. 5A and 5B, the filter layer 200 may have a breathable area (e.g. filter layer breathable area) configured to, in some examples, improve the breathability during operation. Additionally, or alternatively, the exterior layer 100 may have a breathable area (i.e. exterior layer breathable area) configured to, in some examples, improve the breathability during operation. In various embodiments, the breathable area of the exterior layer 100 (i.e. exterior layer breathable area) and the breathable area of the filter layer 200 (i.e. filter layer breathable area) may at least partially overlap in an instance in which the filter layer 200 is coupled to the exterior layer 100.

For example, the exterior layer breathable area may be positioned corresponding to a mouth region of a wearer (for example, the location may be defined in the digital file received by the 3-D knitting machine). The filter layer breathable area may also be positioned corresponding to the mouth region of a wearer (for example, the location may be defined in the digital file received by the 3-D knitting machine). As such, the exterior layer breathable area and the filter layer breathable area may be configured to at least partially overlap in an instance in which the filter layer is coupled to the exterior layer.

While the description above provides an example configuration of overlapping the exterior layer breathable area and the filter layer breathable area, it is noted that the scope of the present disclosure is not limited to the description above. In some examples, additional or alternative configurations may be implemented. For example, the exterior layer breathable area may be positioned along a center line of the exterior layer. Additionally, or alternatively, the filter layer breathable area may be positioned along a center line of the filter layer breathable area, such that the exterior layer breathable area and the filter layer breathable area may at least partially overlap when the mask is worn by the user.

Figure 2G:
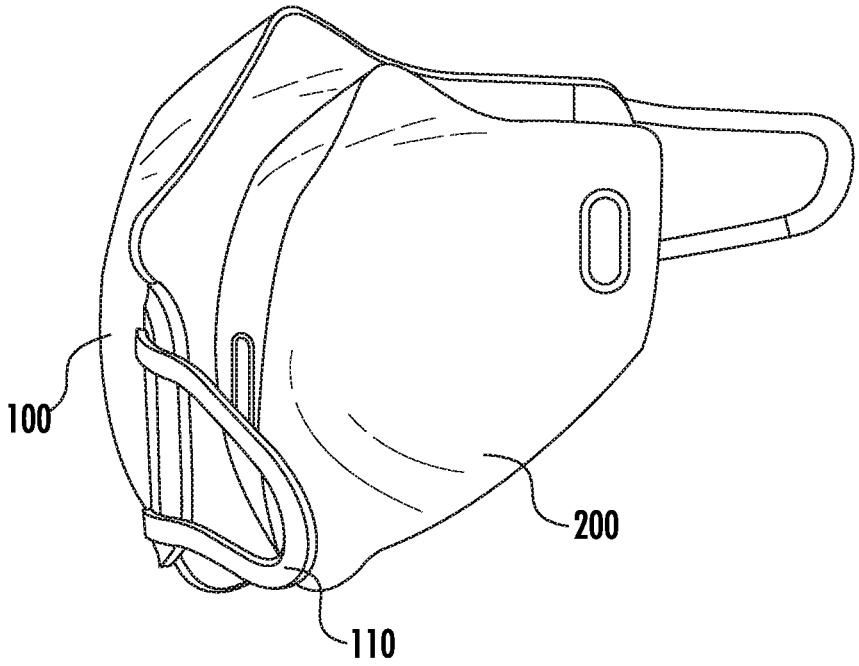
FIG. 2G illustrates an exploded view of an example mask of an example embodiment showing an example exterior layer and an example filter layer along with a plurality of example mask straps in accordance with examples of the present disclosure.

FIG. 2G is an exploded view of the mask of an example embodiment showing the exterior layer and the filter layer along with a plurality of mask straps. As shown, the filter layer 200 may be configured to fit inside of the exterior layer 100, such that the filter layer 200 is not exposed when donned. In various embodiments as discussed herein, the filter layer 200 may be coupled to the exterior layer 100, such as via one or more attachment mechanisms and/or connection mechanisms. In various embodiments, the filter layer 200 may be configured to, in some examples, be easily removed and replaced.

Figure 3:
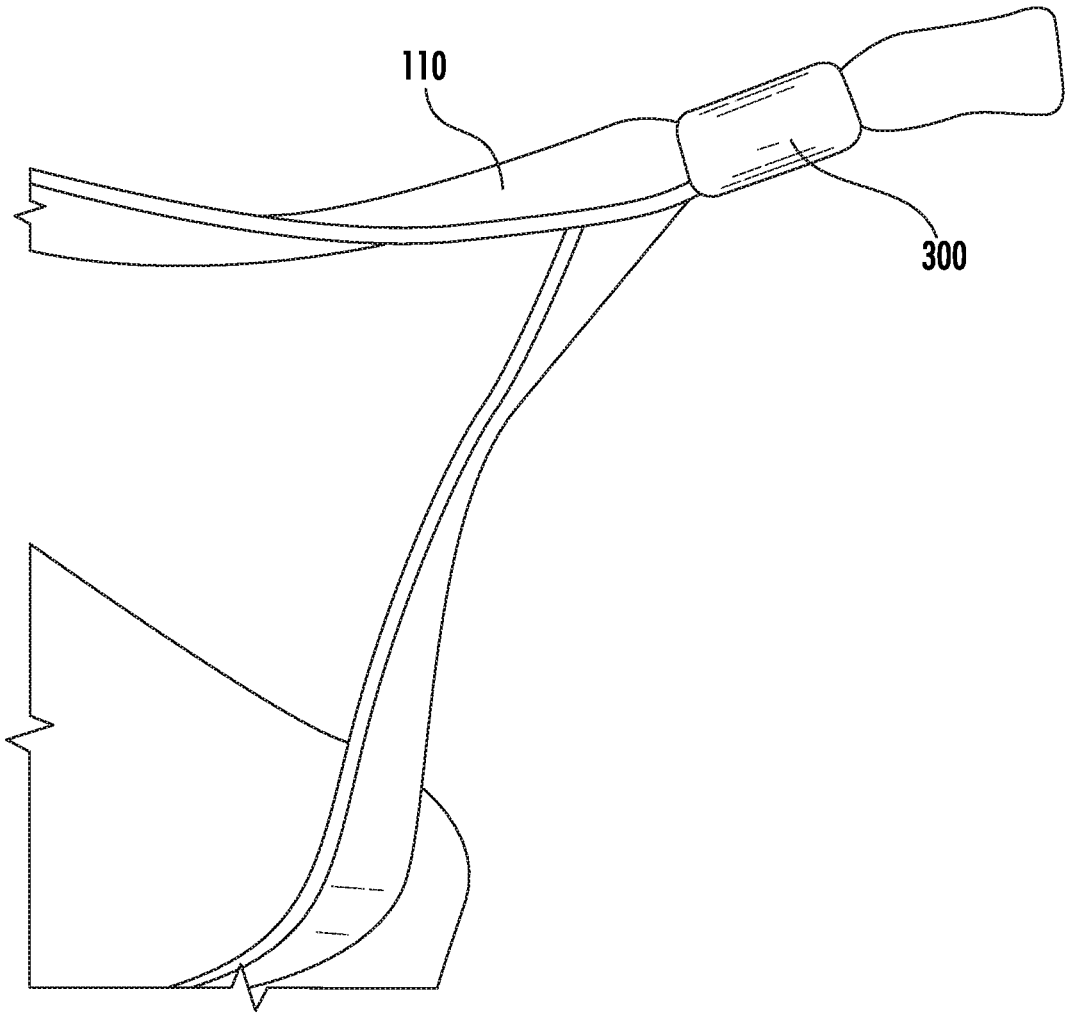
FIG. 3 illustrates an example adjustable mask strap used in an example mask in accordance with examples of the present disclosure.

FIG. 3 is an example adjustable strap in accordance with an example embodiment.

In various embodiments, the mask strap 110 may be adjustable mask strap, and may include one or more adjustors 300 configured to tighten and/or loosen the mask strap 110. For example, as shown in FIG. 3, the adjustor 300 may be configured to move along the strap, such that the opening created by the strap decreases as the adjustor is moved towards the exterior layer 100, while the opening created by the strap increases as the adjustor 300 is moved away from the exterior layer 100. In various embodiments, the adjustor may comprise material such as, but not limited to, a plastic material. In various embodiments, the adjustor 300 may be a generally cylindrical shape with a through-bore configured to receive the strap (e.g., a central through-bore along the length of the adjustor 300). In various embodiments, the through-bore of the adjustor 300 may be sufficiently large to snuggly receive and hold two pieces of the strap together in an instance the adjustor 300 is not being altered by a user. For example, as shown in FIG. 3, the adjustor 300 is configured to hold the strap together, such that the opening created between the strap and the exterior layer 100 remains approximately the same during use, yet the adjustor 300 may be moved by a user. In some examples, the cylindrical shape may include one or more curved edges, such that it may be securely positioned on the strap. In various embodiments, the adjustor 300 may be a different shape, such as a spherical or cubic shape, with a similar function. In various embodiments, the adjustor 300 may be mechanically different, with similar function (e.g., a cord lock may be used to provide a spring-loaded force on the strap).

In various embodiments, the adjustor 300 may allow, in some examples, for the mask to be worn snuggly to the face of users with different sized faces (e.g., larger heads may require the mask strap 110 to be adjusted to a larger opening, such that the mask may be positioned on the user's face). In various embodiments, as shown in FIG. 2G, the mask strap 110 may comprise a first ear strap and a second ear strap, such that a user may secure the mask 10 via the ear straps engaging with the left and/or right ear of the user. In various embodiments, other mask straps 110 may be used to secure the mask 10 in place. For example, the mask 10 of an example embodiment may have a singular strap configured to encapsulate the user's head (e.g., a single strap may connect to the exterior layer 100 at each end and in some instances may also have an adjustor 300 or the like to allow for the user to secure the mask 10 for use).

In various embodiments, the one or more mask straps 110 may have different adjustors for securing the mask 10 on a user. For example, the mask strap(s) 110 may comprise elastic material (for example, polyester fiber), such that the strap(s) may expand to allow for a user to secure the mask (e.g., an ear strap of the mask strap 110 may be elastic, which may allow for a user to pull the ear strap over their ear). Additionally, or alternatively, the strap(s) 110 may comprise other material(s), such as, but not limited to, cotton, spandex, plastic. In various embodiments, the mask strap 110 may be adjustable, such that the mask strap 110 may be a total length allowed for a given opening size, while, in some examples, also being capable of being adjusted to a smaller opening size (e.g., for smaller head size). For example, an example mask strap 110 may be from approximately 190 millimeters to 200 millimeters long and capable of creating a given maximum opening size, while also being adjustable to opening sizes.

Figure 4B:
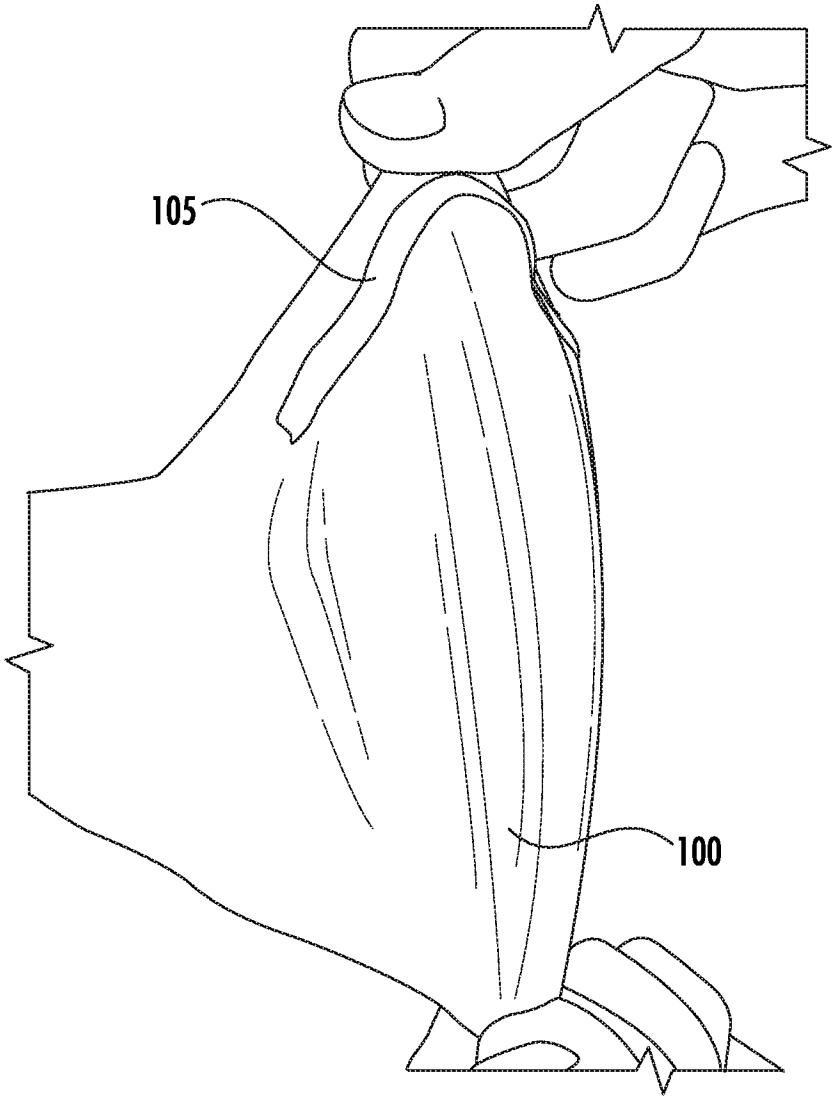
FIG. 4A and FIG. 4B illustrate various example views of an example exterior layer including an example adjustable nose clip of an example mask in accordance with examples of the present disclosure.
Figure 4A:
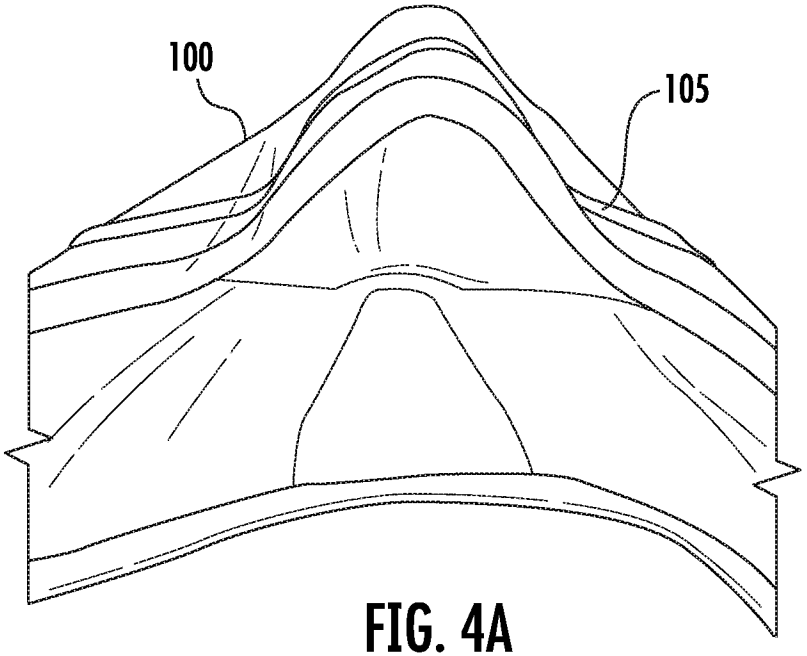

FIGS. 4A and 4B are various views of an example exterior layer including the adjustable nose clip of the mask in accordance with an example embodiment. As shown, the exterior layer 100 may be pattern knitted to allow for the exterior layer 100 to be stretchable in at least one of the warp or the weft. Additionally, as shown in FIG. 4A and discussed above, the exterior layer 100 may have a nose clip 105 configured to secure the exterior layer 100 around the nose of a user during operation. In various embodiments, the nose clip 105 may be a specifically knitted area of the exterior layer 100 to allow the exterior layer 100 to be shaped via movement of the nose clip 105.

While the description above provides an example of the nose clip 105 being integral from the face mask, it is noted that the scope of the present disclosure is not limited to the description above. In some examples, the nose clip 105 may not be integral from the face mask (for example, the nose clip 105 may be disposed on an outer surface of the exterior layer 100).

FIG. 5A and FIG. 5B illustrate an example attachment mechanism used to attach the filter layer to the exterior layer of the mask. In particular, FIG. 5A is a back view of an example mask. FIG. 5A illustrates the filter layer 200 attached to the exterior layer 100. In various embodiments, the filter layer 200 may be disposable and/or removable from the exterior layer 100. In various embodiments, the filter layer 200 may be knitted. In various embodiments, the pattern of the filter layer 200 may be configured to allow for increased breathability in an instance a user is wearing the mask. In various embodiments, the filter layer 200 may have a breathable area 200A (i.e. filter layer breathable area) configured at least at approximately the location of a user's mouth when donned, similar to the breathable area of the exterior layer 100 described above. Additionally, or alternatively, the exterior layer 100 may have a breathable area configured to, in some examples, improve the breathability of the user during operation.

In some examples, the filter layer breathable area may be in a hexagon shape, as shown in FIG. 5A. In some examples, the filter layer breathable area may be in other shape(s), such as but not limited to, rectangular shape.

Similarly, the exterior layer breathable area may be in a hexagon shape. In some examples, the exterior layer breathable area may be in other shape(s), such as but not limited to, rectangular shape.

FIG. 5B illustrates a close-up view of an attachment mechanism 500 that at least partially couples the filter layer 200 and the exterior layer 100. In various embodiments, the attachment mechanism 500 may be a band attached (e.g., sewed) at each end to the exterior layer 100. In various embodiments, the attachment mechanism 500 may be an elastic band, as shown, configured to engage the filter layer 200 in an instance the filter layer 200 is positioned between the attachment mechanism 500 and the exterior layer 100. For example, an edge of the filter layer 200 may be positioned between the attachment mechanism 500 and the exterior layer 100.

In various embodiments, the attachment mechanism 500 may reinforce the attachment between the exterior layer 100 and the filter layer 200 (e.g., the filter layer 200 may be attached to the exterior layer 100 via one or more connection mechanisms and the attachment mechanism 500 may provide additional attachment force). In various embodiments, other methods of coupling may be used to couple the exterior layer 100 and the filter layer 200. For example, the filter layer 200 may be coupled to the exterior layer 100 using buckles, paste, Velcro, magnets, and/or the like.

While the description above illustrates an example of the attachment mechanism 500, it is noted that the scope of the present disclosure is noted limited to the example above. In some examples, one or more other types of attachment mechanisms may be configured to securely attach the filter layer 200 to the exterior layer 100.

Figure 6A:
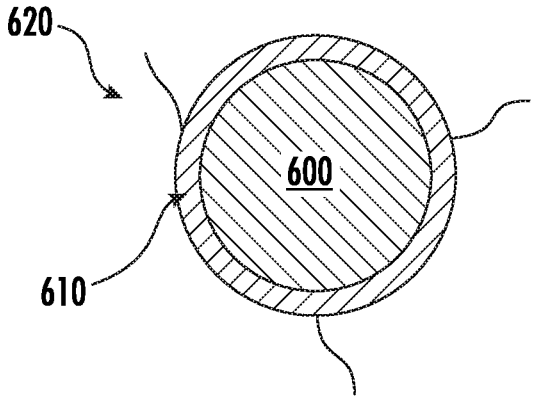
FIG. 6A illustrates an example antimicrobial nonwoven fiber in accordance with examples of the present disclosure.
Figure 6B:
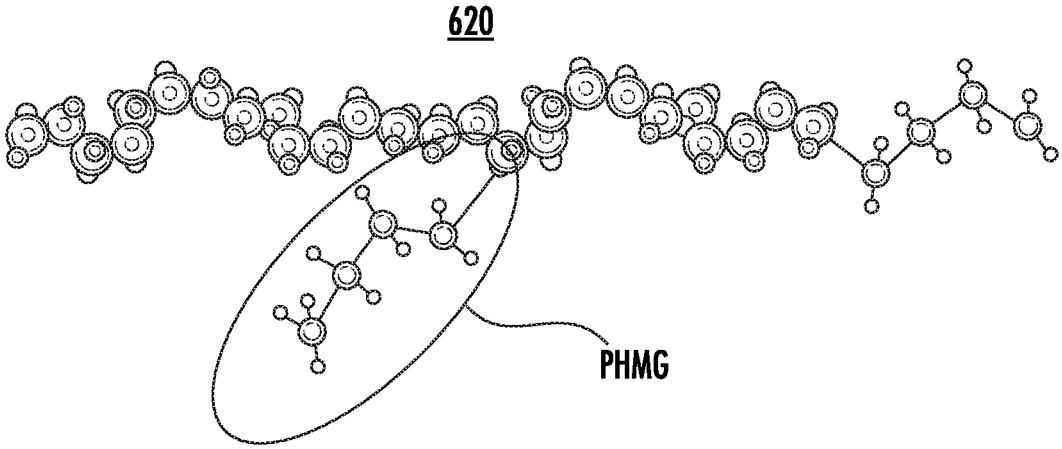
FIG. 6B illustrates an example antimicrobial additive, such as polyhexamethylene guanidine (PHMG), grafted on a polymer chain in accordance with examples of the present disclosure.
Figure 6B:
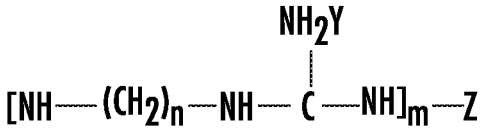

FIG. 6A and FIG. 6B illustrate a nonwoven material. In some examples, the nonwoven material illustrated and described in connection with FIGS. 6A and 6B may be implemented in a variety of products, including but not limited to, PPE products (such as, but not limited to, masks).

In various embodiments, the nonwoven material (e.g. used for mask such as a N95 mask) may use one or more antimicrobial additives, such that the material has antimicrobial attributes. In various embodiments, the antimicrobial additive may be a grafted PHMG (e.g., grafted to polypropylene (PP), polyethylene (PE), polyamide (PA), and/or the like). As shown in FIG. 6A, the fiber used in the nonwoven material may include a core and a sheath. In various embodiments, the sheath and the core may be altered based on the desired properties of the nonwoven fiber. In various embodiments, the core may be a base material without antimicrobial treatment (e.g., the core may be made out of polyester (e.g., PET), polyolefin (e.g., PP, PE), polyamide, and/or the like). In various embodiments, the sheath may surround the core of the nonwoven fiber. For example, the sheath may surround the core completely in a cross-section of the fiber, as shown in FIG. 6A. In various embodiments, the sheath may comprise an antimicrobial material (e.g., grafted PHMG with an optional base material, such as PP, PE, PA, or the like).

In various embodiments, the antimicrobial additive (e.g., grafted PHMG) may be mixed with the raw materials of the sheath mixture before extrusion. For example, the antimicrobial additive may be added to one or more base materials (e.g., PP, PE, PA, and/or the like) to create the sheath mixture. In various embodiment, the sheath mixture may be extruded to be melt as the sheath material 610 of the fiber. In various embodiments, the core materials may be extruded independent of the sheath mixture to be melt as the core material 600 of the fiber. In various embodiments, the core material 600 and the sheath material 610 may be spun out from spinnerets to produce the core and sheath structure shown in FIG. 6A. In various embodiments, various spinning processes (e.g., melt spinning or wet spinning) may be used to produce the webbing for a nonwoven material In various embodiments, the antimicrobial fibers may be used directly to produce the webbing for a nonwoven material. Alternatively or additionally, the antimicrobial fibers may be collected and cut into short fibers before being formed into web via a dry-laid or wet-laid process. In various embodiments, the web may then be bonded together to produce the nonwoven material.

In various embodiments, the core may be approximately 40% to approximately 80% of a total weight of the fiber structure (for example, a total weight of the nonwoven fiber material). In various embodiments, the core may be approximately 60% to approximately 80% of a total weight of the fiber structure (for example, a total weight of the nonwoven fiber material). In various embodiments, the core may be approximately 65% to approximately 75% of a total weight of the fiber structure (for example, a total weight of the nonwoven fiber material).

In various embodiments, the sheath may be approximately 20% to approximately 60% of a total weight of the fiber structure (for example, a total weight of the nonwoven fiber material). In various embodiments, the sheath may be approximately 20% to approximately 40% of a total weight of the fiber structure (for example, a total weight of the nonwoven fiber material). In various embodiments, the sheath may be approximately 25% to approximately 35% of a total weight of the fiber structure (for example, a total weight of the nonwoven fiber material).

In various embodiments, the sheath and the core may combine to approximately 100% of a total weight of the fiber structure (for example, a total weight of the nonwoven fiber material) (e.g., an example fiber structure may be made out of approximately 60% core and approximately 40% sheath). While various embodiments herein use a core and sheath structure, various other fiber structures (e.g., sea-island, orange slice structures) may be used to achieve similar functionality.

FIG. 6B illustrates an antimicrobial additive (e.g., PHMG) grafted on a polymer chain (e.g., polyolefin/polyamide chain) in accordance with an example embodiment. As shown in FIG. 6B, an example antimicrobial fiber chain (e.g., LDPE) is shown in accordance with an example embodiment. As shown, PHMG is grafted to the polymer chain (e.g. LDPE) to form the antimicrobial fiber chain 620 discussed herein. In various embodiments, the PHMG structure may be configured to be grafted to the polymer to create an antimicrobial structure discussed here. In some embodiments, the antimicrobial fiber may have a light color (e.g., the antimicrobial fiber may be slightly yellow), allowing the antimicrobial fiber to be dyed various colors for use.

Embodiments of the present disclosure include antimicrobial fiber or cloth that may be governed by, tested against, or otherwise relevant to associated standards for bacterial resistance. In some instances, these standards may be defined and/or enforced by standards bodies or government agencies. As would be evident to one of ordinary skill in the art, from time to time these standards may be updated or revised to alter the requirements for satisfying the standard (e.g., in order to reduce injuries or other accidents). Additionally, a bacterial resistance standard may be updated in response to analysis of accident statistics and/or in response to improved technologies. The antimicrobial fiber structures described herein are comprised of a combination of different techniques for achieving increased bacteria resistance. The use of a combination of techniques rather than simply using one technique may promote achieving a plurality of at least partly antagonistic objectives and/or to balance the properties of a given design. For example, the antimicrobial fiber may be configured to meet an ASTM E2149 bacteria resistance standard. HMPE yarn made out of antimicrobial fiber of an example embodiment, when tested using the AATCC 100-2012 test, results in a reduction of over 99.9% for *Escherichia Coli* according to the ATCC 8739 standard and over 99.9% reduction for *Staphylococcus aureus* according to the ATCC 6538 standard. Additionally, antimicrobial fiber of an example embodiment resulted in a reduction of over 99% for *Escherichia Coli* according to the ASTM 2149-2013a. In various embodiments, the antimicrobial fiber may also be configured to meet other testing standards, such as ISO 20743 (antibacterial test) and ISO 18184 (anti-virus test).

While FIG. 6A-FIG. 6B and the above description illustrate example materials for masks, it is noted that example materials of the present disclosure may be implemented in products other than masks. For example, example materials of the present disclosure may be implemented in other type(s) of personal protective equipment and/or other products.

As described above, protective clothing (for example, protective garment) may minimize, reduce, and/or eliminate the user's exposure to hazardous, infectious, and/or contagious particulates, substances, materials, and/or environment. During the manufacturing process of protective garment, one or more segments of protective garment (for example, one or more pieces of material for the protective garment that may have been cut based on one or more specifications) may need to be joined, attached, and/or otherwise connected with one another to form at least a part of the protective garment. For example, two segments may be connected to one another by at least forming a seam that joins one edge of one segment with another edge of another segment.

However, seams of a protective garment may be weak points in protecting a wearer from airborne particulate matters (for example, viruses), biohazards, chemical hazards, electrical hazards, physical hazards, and/or other types of environmental hazards. For example, to form a seam, an example manufacturing process may implement sewing techniques based on a needle and thread. The needle may cause one or more holes to be formed on at least a surface of one segment to allow the thread to pass through. In some situations, airborne particulate matters (for example, viruses) may pass through the one or more holes. As such, the less the seams are, the more efficacious the protective garment is in protecting a wearer. Further, the less the seals are associated with the protective garment, the easier the connecting processing (for example, sewing) for connecting segments to form a protective garment.

In some examples, a protective garment may comprise an upper segment that may be configured to cover a wearer's upper torso. In these examples, the upper segment may comprise two segments: a left segment (which may cover a left arm region of a wearer) and a right segment (which may cover a right arm region of the wearer). The left segment may be connected to the right segment through a middle line seam or zipper on the front portion of the upper segment (for example, covering the chest region of the wearer) and/or a middle line seam or zipper on the back portion of the upper segment (for example, covering the back region of the wearer). In such examples, the middle line seam or zipper on the front/back portion of the upper segment may impact the efficacy of the protective garment.

Figure 7:
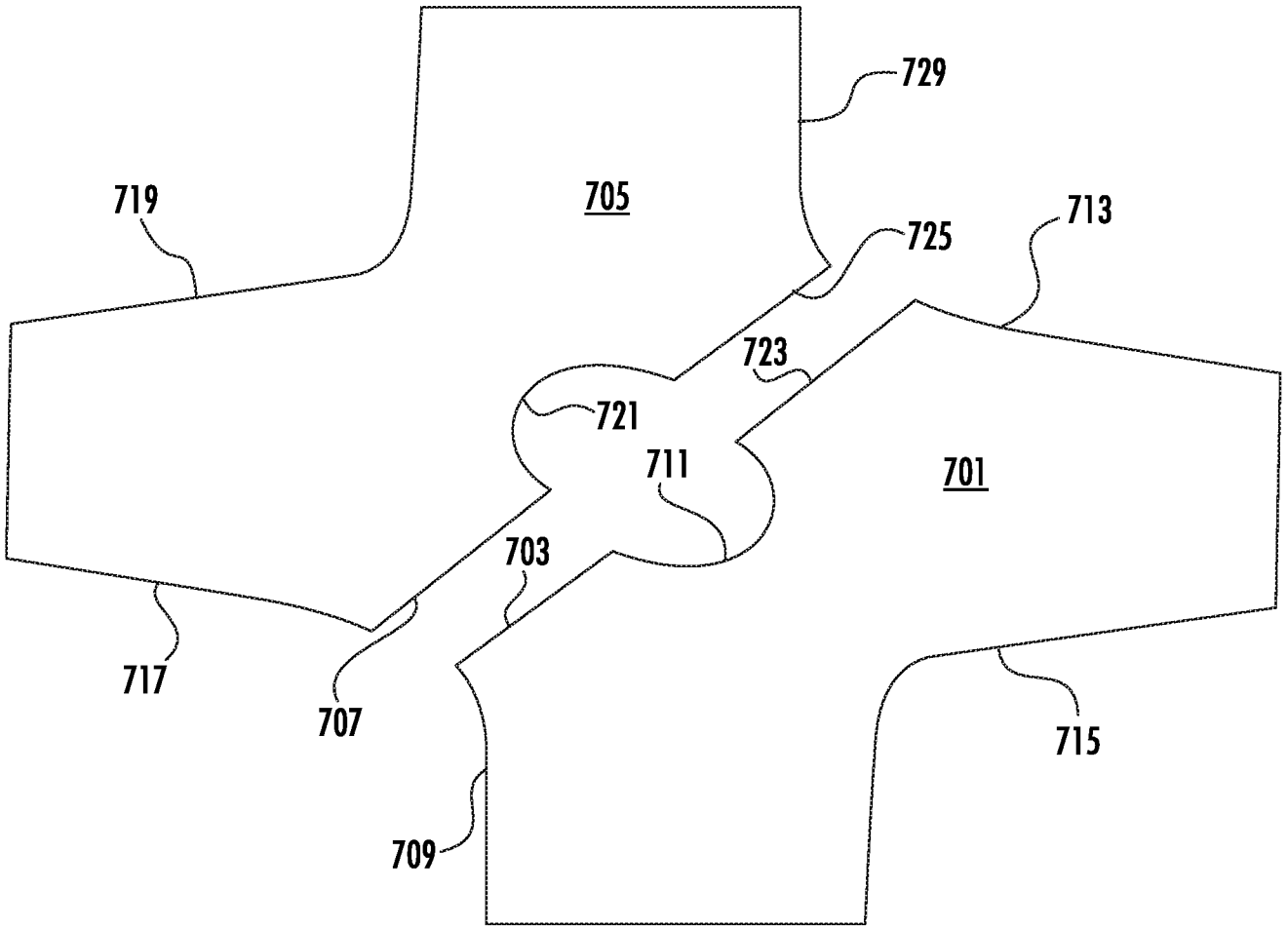
FIG. 7 illustrates an example schematic diagram showing an example front segment and an example back segment of an example protective garment in accordance with examples of the present disclosure.

In accordance with various examples of the present discourse, the length(s) of seam(s) associated with the upper segment may be reduced. Referring now to FIG. 7, an example schematic diagram illustrating an example front segment 701 and an example back segment 705 of a protective garment is illustrated. Based on the schematic diagram of FIG. 7, an example method for manufacturing a protective garment may be provided.

In some examples, the example method for manufacturing a protective garment may include providing a front segment 701.

In some examples, the front segment 701 may comprise nonwoven material that may have antimicrobial and/or antibacterial properties. For example, the nonwoven material may comprise one or more staple fiber and long fibers that may be bonded together through heat, solvent, chemical, and/or mechanical. In some examples, the antimicrobial treatment may be applied to nonwoven material. For example, one or more antimicrobial additive(s) (such as, but not limited to, polyhexamethylene biguanide (PHMB), silane quaternary ammonia compounds, zinc pyrithione, and/or silver) may be applied to the nonwoven material through coating, padding, exhaustion and/or foaming.

While the description above provides some example materials for the front segment 701, it is noted that the scope of the present disclosure is not limited to the description above. In some examples, an example front segment 701 may comprise one or more additional and/or alternative material(s).

Referring back to FIG. 7, the front segment 701 may comprise a first raglan edge 703. As used herein, the term "raglan edge" refers to an edge of a segment of a protective garment that may connect a sleeve portion of an example protective garment that is manufactured in accordance with examples of the present disclosure to the neck opening of the example protective garment.

In the example shown in FIG. 7, the front segment 701 comprises a first side edge 709 and a front neck opening edge 711. When a wearer puts on an example protective garment that is manufactured in accordance with examples of the present disclosure, the first side edge 709 may be positioned on a right side of an upper torso of the wearer of the protective garment, and the front neck opening edge 711 may provide at least a partial edge for a neck opening that may allow the wearer to put his or her head through. In this example, the first raglan edge 703 may connect the first side edge 709 and the front neck opening edge 711.

In some examples, the front segment 701 may comprise a first arm edge 713 and a second arm edge 715. In some examples, the example method for manufacturing a protective garment may comprise forming a first sleeve portion by joining the first arm edge 713 and the second arm edge 715. For example, the example method may implement sewing techniques to connect, fasten, and/or otherwise join the first arm edge 713 and the second arm edge 715. Additionally, or alternatively, the example method may implement other techniques to join the first arm edge 713 and the second arm edge 715.

In some examples, the first sleeve portion may comprise a first armhole of the protective garment. For example, when a wearer puts on an example protective garment that is manufactured in accordance with examples of the present disclosure, the first armhole may allow the wearer to put his or her arm through, and the first sleeve portion may cover at least part of the arm portion of the wearer.

In some examples, the example method for manufacturing a protective garment may comprise providing a back segment 705.

Similar to the front segment 701 described above, the back segment 705 may comprise nonwoven material that may have antimicrobial and/or antibacterial properties. For example, the nonwoven material may comprise one or more staple fiber and long fibers that may be bonded together through heat, solvent, chemical, and/or mechanical. In some examples, the antimicrobial treatment may be applied to nonwoven material. For example, one or more antimicrobial additive(s) (such as, but not limited to, polyhexamethylene biguanide (PHMB), silane quaternary ammonia compounds, zinc pyrithione, and/or silver) may be applied to the nonwoven material through coating, padding, exhaustion and/or foaming.

While the description above provides some example materials for the back segment 705, it is noted that the scope of the present disclosure is not limited to the description above. In some examples, an example back segment 705 may comprise one or more additional and/or alternative material(s).

Referring back to FIG. 7, the back segment 705 may comprise a third arm edge 717 and a fourth arm edge 719. In some examples, the example method for manufacturing a protective garment may comprise forming a second sleeve portion by joining the third arm edge 717 and the fourth arm edge 719. For example, the example method may implement sewing techniques to connect, fasten, and/or otherwise join the third arm edge 717 and the fourth arm edge 719. Additionally, or alternatively, the example method may implement other techniques to join the third arm edge 717 and the fourth arm edge 719.

In some examples, the second sleeve portion may comprise a second armhole of the protective garment. For example, when a wearer puts on an example protective garment that is manufactured in accordance with examples of the present disclosure, the second armhole may allow the wearer to put his or her arm through, and the second sleeve portion may cover at least part of the arm portion of the wearer.

In some examples, the back segment 705 may comprise a back neck opening edge 721. When a wearer puts on an example protective garment that is manufactured in accordance with examples of the present disclosure, the back segment 705 may provide at least a partial edge for a neck opening that may allow the wearer to put his or her head through.

In the example shown in FIG. 7, the back segment 705 may comprise a second raglan edge 707. Similar to the first raglan edge 703 described above, the second raglan edge 707 may connect a sleeve portion of an example protective garment that is manufactured in accordance with examples of the present disclosure to the neck opening of the example protective garment. For example, the second raglan edge 707 may connect the third arm edge 717 and the back neck opening edge 721. When a wearer puts on an example protective garment that is manufactured in accordance with examples of the present disclosure, the second raglan edge 707 may connect the second sleeve portion (for example, the second armhole of the protective garment) with the neck opening.

In some examples, the example method for manufacturing a protective garment may comprise connecting the front segment 701 and the back segment 705 by at least forming a front raglan seam joining the first raglan edge 703 and the second raglan edge 707.

For example, the example method may implement sewing techniques to connect, fasten, and/or otherwise join the first raglan edge 703 and the second raglan edge 707 to from the front raglan seam. Additionally, or alternatively, the example method may implement other techniques to join the first raglan edge 703 and the second raglan edge 707. For example, subsequent to forming the front raglan seam, one or more sealing tapes (for example, nonwoven sealing tapes) may be applied on the stitch line of the front raglan seam, such that the front raglan seam may be sealed.

In some examples, when a wearer puts on an example protective garment that is manufactured in accordance with examples of the present disclosure, the front raglan seam may connect the neck opening of the protective garment and an armhole of the protective garment (for example, the armhole that allows a wearer to put his or her right arm through).

Referring back to FIG. 7, the front segment 701 may comprise a third raglan edge 723. Similar to the first raglan edge 703 and the second raglan edge 707 described above, the third raglan edge 723 may connect a sleeve portion of an example protective garment that is manufactured in accordance with examples of the present disclosure to the neck opening of the example protective garment. For example, the third raglan edge 723 may connecting the front neck opening edge 711 of the front segment 701 and the first arm edge 713 of the front segment 701.

In some examples, the back segment 705 may comprise a fourth side edge 729. When a wearer puts on an example protective garment that is manufactured in accordance with examples of the present disclosure, the fourth side edge 729 may be positioned on a left side of an upper torso of a wearer of the protective garment.

In some examples, the back segment 705 may comprise a fourth raglan edge 725. Similar to the first raglan edge 703, the second raglan edge 707, and the third raglan edge 723 described above, the fourth raglan edge 725 may connect a sleeve portion of an example protective garment that is manufactured in accordance with examples of the present disclosure to the neck opening of the example protective garment. For example, the fourth raglan edge 725 may connect the back neck opening edge 721 of the back segment 705 and the fourth side edge 729 of the back segment 705.

In some examples, when connecting the front segment 701 and the back segment 705, the example method for manufacturing a protective garment may further comprise forming a back raglan seam joining the third raglan edge 723 and the fourth raglan edge 725.

For example, the example method may implement sewing techniques to connect, fasten, and/or otherwise join the third raglan edge 723 and the fourth raglan edge 725 to from the back raglan seam. Additionally, or alternatively, the example method may implement other techniques to join the third raglan edge 723 and the fourth raglan edge 725. For example, subsequent to forming the back raglan seam, one or more sealing tapes (for example, nonwoven sealing tapes) may be applied on the stitch line of the back raglan seam, such that the back raglan seam may be sealed.

In some examples, when a wearer puts on an example protective garment that is manufactured in accordance with examples of the present disclosure, the back raglan seam may connect the neck opening of the protective garment and an armhole of the protective garment (for example, the armhole that allows a wearer to put his or her left arm through).

Figure 8A:
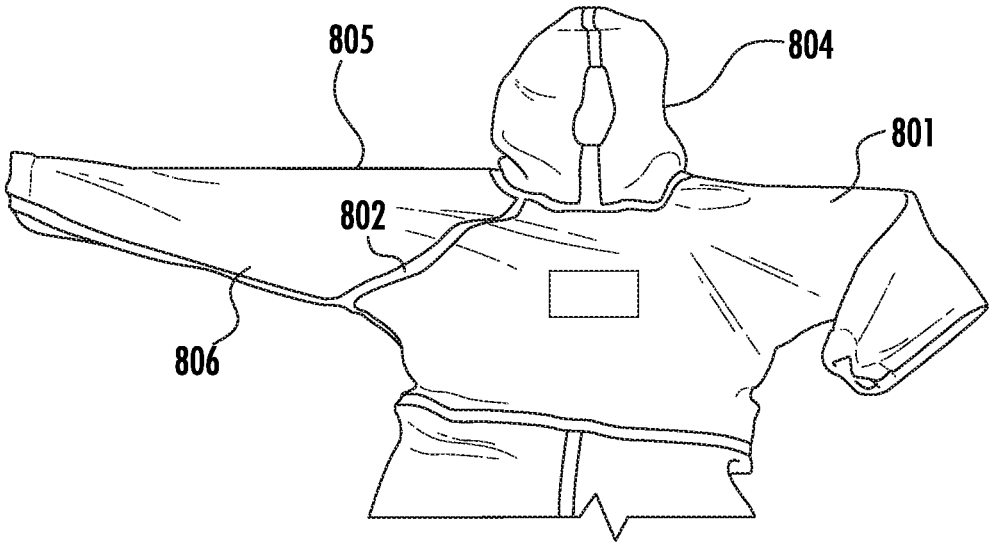
FIG. 8A and FIG. 8B illustrate various example views of an example protective garment in accordance with examples of the present disclosure.
Figure 8B:
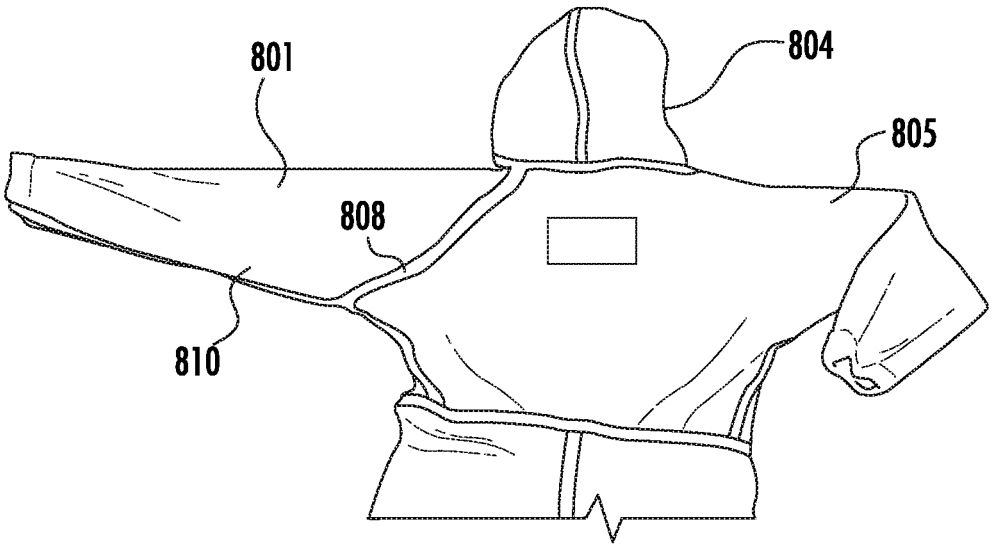

As such, various examples of the present disclosure may provide a protective garment that may comprise a front segment and a back segment. The front segment may comprise a first raglan edge, and the back segment may comprise a second raglan edge. The first raglan edge and the second raglan edge may be joined to form a front raglan seam. Referring now to FIG. 8A and FIG. 8B, an example front view (FIG. 8A) and an example back view (FIG. 8B) of an example protective garment that is manufactured in accordance with examples of the present disclosure are illustrated.

Referring to FIG. 8A, the example protective garment may comprise a front segment 801 and a back segment 805, similar to the front segment 701 and the back segment 705, respectively, described above in connection with FIG. 7.

In some examples, the protective garment may comprise a sleeve portion 806, which may be formed by joining a third arm edge and a fourth arm edge of the back segment 805, similar to those described above in connection with FIG. 7. In some examples, the sleeve portion 806 may be configured to at least partially cover the left arm region of a wearer.

In some examples, the protective garment may comprise a hood segment 804, which may be configured to cover at least a portion of a wearer's head. In some examples, the hood segment 804 may be connected to the front segment 801 and the back segment 805 through a neck opening edge (for example, a front neck opening edge and/or a back neck opening edge), similar to those described above in connection with FIG. 7.

In the example shown in FIG. 8A, the front raglan seam 802 may connect the sleeve portion 806 of the protective garment to a neck opening edge of the protective garment (and thereby may connect the sleeve portion 806 with the hood segment 804).

In some examples, the length of the front raglan seam 802 may correlate to the size of the protective garment. For example, the length of the front raglan seam 802 may be 35 centimeters for a small-sized protective garment (i.e. the minimum length from the front neck opening edge to the front waist edge is 42 centimeters). The length of the front raglan seam 802 may be 37 centimeters for a medium-sized protective garment (i.e. the minimum length from the front neck opening edge to the front waist edge is 45 centimeters). The length of the front raglan seam 802 may be 39 centimeters for a large-sized protective garment (i.e. the minimum length from the front neck opening edge to the front waist edge is 48 centimeters). The length of the front raglan seam 802 may be 41 centimeters for an extra-large-sized protective garment (i.e. the minimum length from the front neck opening edge to the front waist edge is 51 centimeters). The length of the front raglan seam 802 may be 43 centimeters for an double-extra-large-sized protective garment (i.e. the minimum length from the front neck opening edge to the front waist edge is 54 centimeters). The length of the front raglan seam 802 may be 45 centimeters for an triple-extra-large-sized protective garment (i.e. the minimum length from the front neck opening edge to the front waist edge is 57 centimeters).

While the description above provides example lengths of the front raglan seam 802, it is noted that the scope of the present disclosure is not limited to the description above. In some examples, an example front raglan seam 802 may have other length value(s).

Referring to FIG. 8B, the protective garment may comprise a sleeve portion 810, which may be formed by joining a first arm edge and a second arm edge of the front segment 801, similar to those described above in connection with FIG. 7. In some examples, the sleeve portion 810 may be configured to at least partially cover the right arm region of a wearer.

In the example shown in FIG. 8B, the back raglan seam 808 may connect the sleeve portion 810 of the protective garment to a neck opening edge of the protective garment (and thereby may connect the sleeve portion 810 with the hood segment 804).

In some examples, the length of the back raglan seam 808 may correlate to the size of the protective garment. For example, the length of the back raglan seam 808 may be 40 centimeters for a small-sized protective garment (i.e. the minimum length from the back neck opening edge to the back waist edge is 51 centimeters). The length of the back raglan seam 808 may be 42 centimeters for a medium-sized protective garment (i.e. the minimum length from the back neck opening edge to the back waist edge is 54 centimeters). The length of the back raglan seam 808 may be 44 centimeters for a large-sized protective garment (i.e. the minimum length from the back neck opening edge to the back waist edge is 57 centimeters). The length of the back raglan seam 808 may be 46 centimeters for an extra-large-sized protective garment (i.e. the minimum length from the back neck opening edge to the back waist edge is 60 centimeters). The length of the back raglan seam 808 may be 48 centimeters for an double-extra-large-sized protective garment (i.e. the minimum length from the back neck opening edge to the back waist edge is 63 centimeters). The length of the back raglan seam 808 may be 50 centimeters for an triple-extra-large-sized protective garment (i.e. the minimum length from the back neck opening edge to the back waist edge is 66 centimeters).

While the description above provides example lengths of the back raglan seam 808, it is noted that the scope of the present disclosure is not limited to the description above. In some examples, an example back raglan seam 808 may have other length value(s).

By forming the front raglan seam 802 and the back raglan seam 808, examples of the present disclosure may reduce sewing length of the seam as compared to a middle line seam on the front portion and/or a middle line seam on the back portion of an upper segment. As such, examples of the present disclosure may improve safety and seal level of protective garments, and may improve the efficacy of the protective garment to protect a wearer.

Protective garments may be worn by people having different body shapes. For example, female wearers may need or require protective garment to have a large volume in the chest region of the upper segment as compared to the need or requirement for male wearers. However, many protective garments do not accommodate for these needs or requirements. As such, female wearers may feel uncomfortable after wearing such protective garments for a period of time. Some female wearers may choose to wear protective garment that is a larger size than their normal size to receive volume in the chest region. However, larger sized protective garments may cause problems such as difficulty in moving due to long sleeve portions and/or leg portions of the protective garment.

Figure 9A:
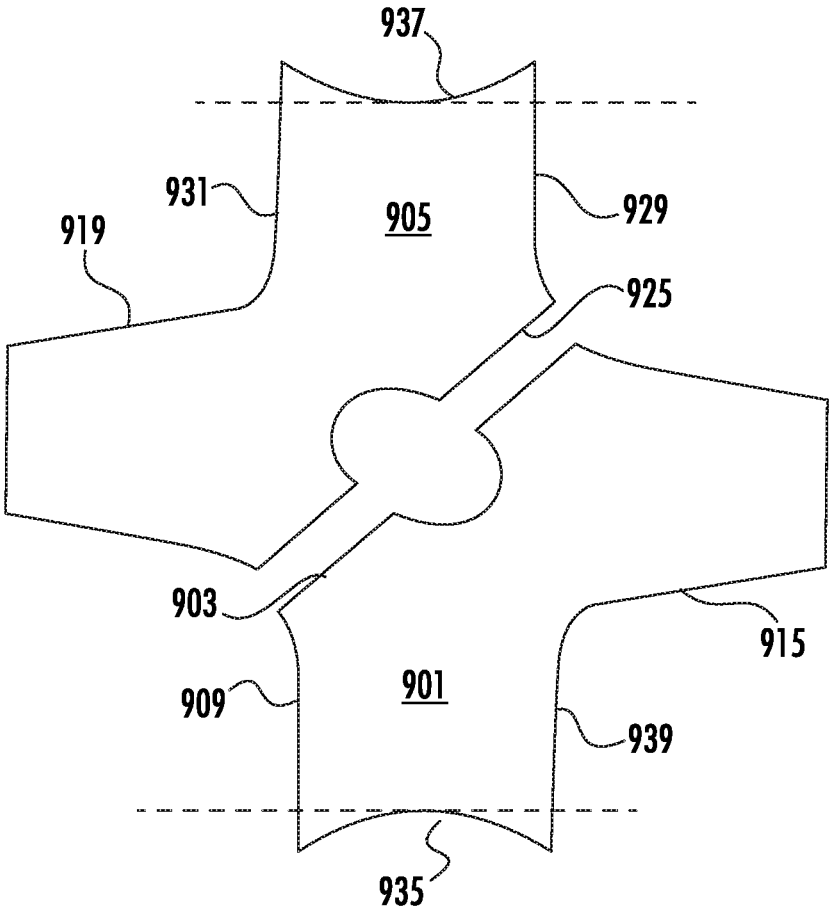
FIG. 9A, FIG. 9B, and FIG. 9C illustrate example schematic diagrams showing example front segments and example back segments of example protective garments in accordance with examples of the present disclosure.
Figure 9B:
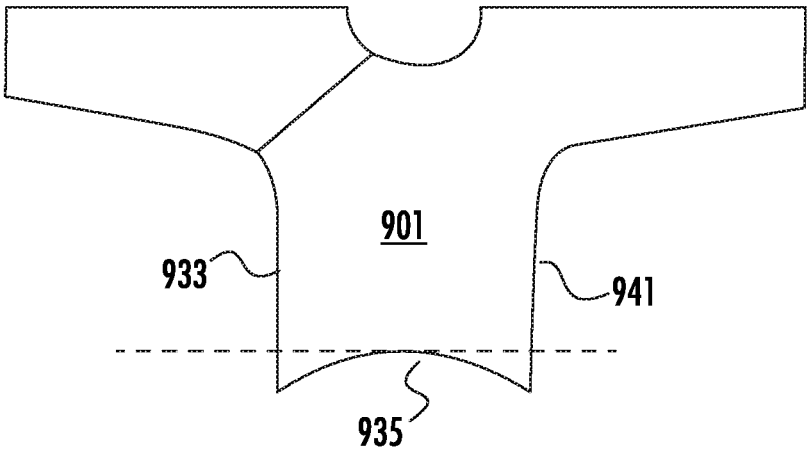
Figure 9C:
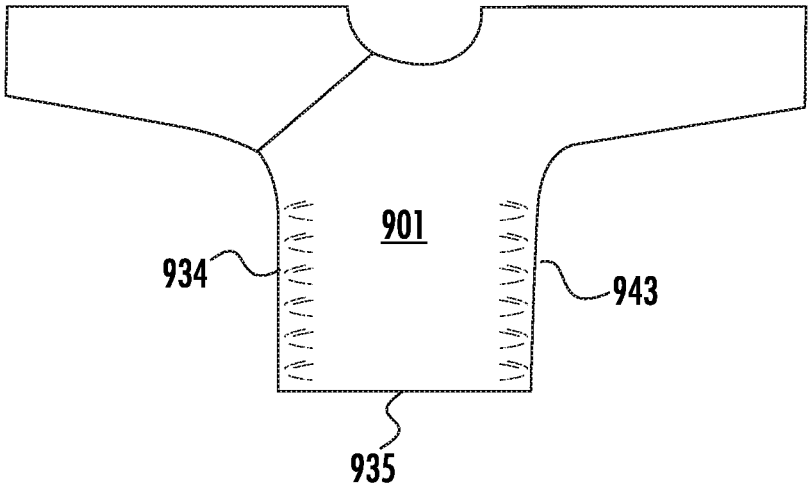

In accordance with various examples of the present discourse, a protective garment may provide accommodation for the body shape of female wearers. Referring now to FIG. 9A, FIG. 9B, and FIG. 9C, example schematic diagrams illustrating an example front segment 901 and/or an example back segment 905 of a protective garment are illustrated. Based on the schematic diagrams of FIG. 9A, FIG. 9B, and FIG. 9C, an example method for manufacturing a protective garment may be provided.

Referring now to FIG. 9A, in some examples, the example method for manufacturing a protective garment may include providing a front segment 901.

Similar to the front segment 701 described above in connection with FIG. 7, the front segment 901 may comprise nonwoven material that may have antimicrobial and/or antibacterial properties. For example, the nonwoven material may comprise one or more staple fiber and long fibers that may be bonded together through heat, solvent, chemical, and/or mechanical. In some examples, the antimicrobial treatment may be applied to nonwoven material. For example, one or more antimicrobial additive(s) (such as, but not limited to, polyhexamethylene biguanide (PHMB), silane quaternary ammonia compounds, zinc pyrithione, and/or silver) may be applied to the nonwoven material through coating, padding, exhaustion and/or foaming.

While the description above provides some example materials for the front segment 901, it is noted that the scope of the present disclosure is not limited to the description above. In some examples, an example front segment 901 may comprise one or more additional and/or alternative material(s).

In the example shown in FIG. 9A, the front segment 901 may comprise a first raglan edge 903. Similar to the first raglan edge 703 described above in connect ion with FIG. 7, the first raglan edge 903 may connect a sleeve portion of an example protective garment that is manufactured in accordance with examples of the present disclosure to the neck opening of the example protective garment.

In some examples, the front segment 901 may comprise a front waist edge 935. When a wearer puts on an example protective garment that is manufactured in accordance with examples of the present disclosure, the front waist edge 935 may be positioned on a front waistline of the wearer.

In some examples, the front segment 901 may comprise a first side edge 909. In some examples, the first side edge 909 may connect the first raglan edge 903 and the front waist edge 935.

Referring back to FIG. 9A, in some examples, the example method for manufacturing a protective garment may include providing a back segment 905.

Similar to the back segment 705 described above in connection with FIG. 7, the back segment 905 may comprise nonwoven material that may have antimicrobial and/or antibacterial properties. For example, the nonwoven material may comprise one or more staple fiber and long fibers that may be bonded together through heat, solvent, chemical, and/or mechanical. In some examples, the antimicrobial treatment may be applied to nonwoven material. For example, one or more antimicrobial additive(s) (such as, but not limited to, polyhexamethylene biguanide (PHMB), silane quaternary ammonia compounds, zinc pyrithione, and/or silver) may be applied to the nonwoven material through coating, padding, exhaustion and/or foaming.

While the description above provides some example materials for the back segment 905, it is noted that the scope of the present disclosure is not limited to the description above. In some examples, an example back segment 905 may comprise one or more additional and/or alternative material(s).

In the example shown in FIG. 9A, the back segment 905 may comprise a fourth arm edge 919, similar to the fourth arm edge 719 described above in connection with FIG. 7. In some examples, the back segment 905 may comprise a back waist edge 937. When a wearer puts on an example protective garment that is manufactured in accordance with examples of the present disclosure, the back waist edge 937 may be positioned on a back waistline of the wearer.

In some examples, the back segment 905 may comprise a second side edge 931. In some examples, the second side edge 931 may connect the fourth arm edge 919 and the back waist edge 937.

Referring now to FIG. 9B, in some examples, the example method for manufacturing a protective garment may include connecting the front segment 901 and the back segment 905 by at least forming a first side seam 933 joining the first side edge 909 and the second side edge 931.

For example, the example method may implement sewing techniques to connect, fasten, and/or otherwise join the first side edge 909 and the second side edge 931 to from the first side seam 933. Additionally, or alternatively, the example method may implement other techniques to join the first side edge 909 and the second side edge 931. For example, subsequent to forming the first side seam 933, one or more sealing tapes (for example, nonwoven sealing tapes) may be applied on the stitch line of the first side seam 933, such that the first side seam 933 may be sealed.

In some examples, when a wearer puts on an example protective garment that is manufactured in accordance with examples of the present disclosure, the first side seam 933 may be located on a side of the chest region of the wearer (for example, the right side of the chest region of the wearer).

Referring now to FIG. 9B and FIG. 9C, in some examples, the example method for manufacturing a protective garment may include forming a first shining stitch seam 934 based on the first side seam 933. In some examples, the first shirring stitch seam 934 may be shorter than the first side seam 933.

As used here, the term "shining stitch seam" refers to a seam of a segment of a protective garment where example shining techniques may have been applied. As an example, the first side seam 933 may be attached to an elastic band through shirring stiches. The elastic band may comprise material such as, but not limited to, spandex, that may provide elastic properties.

In some examples, the first side seam 933 may be attached to the elastic band when the elastic band is in a stretched state (for example, by applying a force one or both ends of the elastic band and stretching the elastic band). The shirring stiches may include elastic threads. After the first side seam 933 is attached to the elastic band, the elastic band may return to a relaxed state (for example, by removing the force that stretches the elastic band). As a result, the first shining stitch seam 934 may be formed by the first side seam 933 and the elastic band, and may be shorter than the first side seam 933.

In some examples, the elastic band may be disposed on an inner surface of the protective garment. For example, the elastic band may be positioned along the first side seam 933 on an inner surface of the protective garment. Additionally, or alternatively, the elastic band may be positioned along the first side edge 909 and/or the second side edge 931 of the first side seam 933. In some examples, the elastic band may be disposed on an outer surface of the protective garment. In some examples, more than one elastic band may be used.

While the description above provides an example of forming a first shining stitch seam 934 based on the first side seam 933, it is noted that the scope of the present disclosure is not limited to the description above. In some examples, other techniques may additionally or alternatively be used.

In some examples, a length difference between the first shirring stitch seam 934 and the first side seam 933 may be within a range between 5 centimeters and 11 centimeters. In some examples, the length difference may be 8 centimeters. For example, the length of the first side seam 933 may be 25 centimeters, and the length of the first shirring stitch seam 934 may be 17 centimeters.

While the description above provides examples of length of and length difference between the first shirring stitch seam 934 and the first side seam 933, it is noted that the scope of the present disclosure is not limited to the description above. In some examples, an example length of and/or length difference between the first shirring stitch seam 934 and the first side seam 933 may comprise other values.

In some examples, when a wearer puts on an example protective garment that is manufactured in accordance with examples of the present disclosure, the first shirring stitch seam 934 may be positioned on a right side portion of the chest region of the wearer. At least because of the first shirring stitch seam 934, the example protective garment may provide volume in at least the right side portion of the chest region of the wearer.

Referring back to FIG. 9A, in some examples, the front segment 901 may comprise a second arm edge 915, similar to the second arm edge 715 described above in connection with FIG. 7. In some examples, the front segment 901 may comprise a third side edge 939. In some examples, the third side edge 939 may connect the front waist edge 935 and the second arm edge 915.

In some examples, the back segment 905 may comprise a fourth raglan edge 925, similar to the fourth raglan edge 725 described above in connection with FIG. 7. In some examples, the back segment 905 may comprise a fourth side edge 929. In some examples, the fourth side edge 929 may connect the fourth raglan edge 925 and the back waist edge 937.

Referring now to FIG. 9B, the example method for manufacturing a protective garment may include connecting the front segment 901 and the back segment 905 by at least forming a second side seam 941 joining the third side edge 939 and the fourth side edge 929.

For example, the example method may implement sewing techniques to connect, fasten, and/or otherwise join the third side edge 939 and the fourth side edge 929 to from second side seam 941. Additionally, or alternatively, the example method may implement other techniques to join the third side edge 939 and the fourth side edge 929. For example, subsequent to forming the second side seam 941, one or more sealing tapes (for example, nonwoven sealing tapes) may be applied on the stitch line of the second side seam 941, such that the second side seam 941 may be sealed.

In some examples, when a wearer puts on an example protective garment that is manufactured in accordance with examples of the present disclosure, the second side seam 941 may be located on a side of the chest region of the wearer (for example, the left side of the chest region of the wearer).

Referring now to FIG. 9B and FIG. 9C, in some examples, the example method for manufacturing a protective garment may include forming a second shirring stitch seam 943 based on the second side seam 941. In some examples, the second shirring stitch seam 943 may be shorter than the second side seam 941.

Similar to those described above, the second side seam 941 may be attached to an elastic band through shirring stiches. The elastic band may comprise material such as, but not limited to, spandex, that may provide elastic properties. The second side seam 941 may be attached to the elastic band when the elastic band is in a stretched state (for example, by applying a force one or both ends of the elastic band and stretching the elastic band). The shirring stiches may include elastic threads. After the second side seam 941 is attached to the elastic band, the elastic band may return to a relaxed state (for example, by removing the force that stretches the elastic band). As a result, the second shirring stitch seam 943 may be formed by the second side seam 941 and the elastic band, and may be shorter than the second side seam 941.

In some examples, the elastic band may be disposed on an inner surface of the protective garment. For example, the elastic band may be positioned along the second side seam 941 on an inner surface of the protective garment. Additionally, or alternatively, the elastic band may be positioned along the third side edge 939 and/or the fourth side edge 929 of the second side seam 941. In some examples, the elastic band may be disposed on an outer surface of the protective garment. In some examples, more than one elastic band may be used.

While the description above provides an example of forming a second shirring stitch seam 943 based on the second side seam 941, it is noted that the scope of the present disclosure is not limited to the description above. In some examples, other techniques may additionally or alternatively be used.

In some examples, a length difference between the second shirring stitch seam 943 and the second side seam 941 may be within a range between 5 centimeters and 11 centimeters. In some examples, the length difference may be 8 centimeters. For example, the length of the second side seam 941 may be 25 centimeters, and the length of the second shining stitch seam 943 may be 17 centimeters.

While the description above provides examples of length of and length difference between the second shining stitch seam 943 and the second side seam 941, it is noted that the scope of the present disclosure is not limited to the description above. In some examples, an example length of and/or length difference between the second shirring stitch seam 943 and the second side seam 941 may comprise other values.

In some examples, when a wearer puts on an example protective garment that is manufactured in accordance with examples of the present disclosure, the second shining stitch seam 943 may be positioned on a left side portion of the chest region of the wearer. At least because of the second shirring stitch seam 943, the example protective garment may provide volume in at least the left side portion of the chest region of the wearer.

Figure 10:
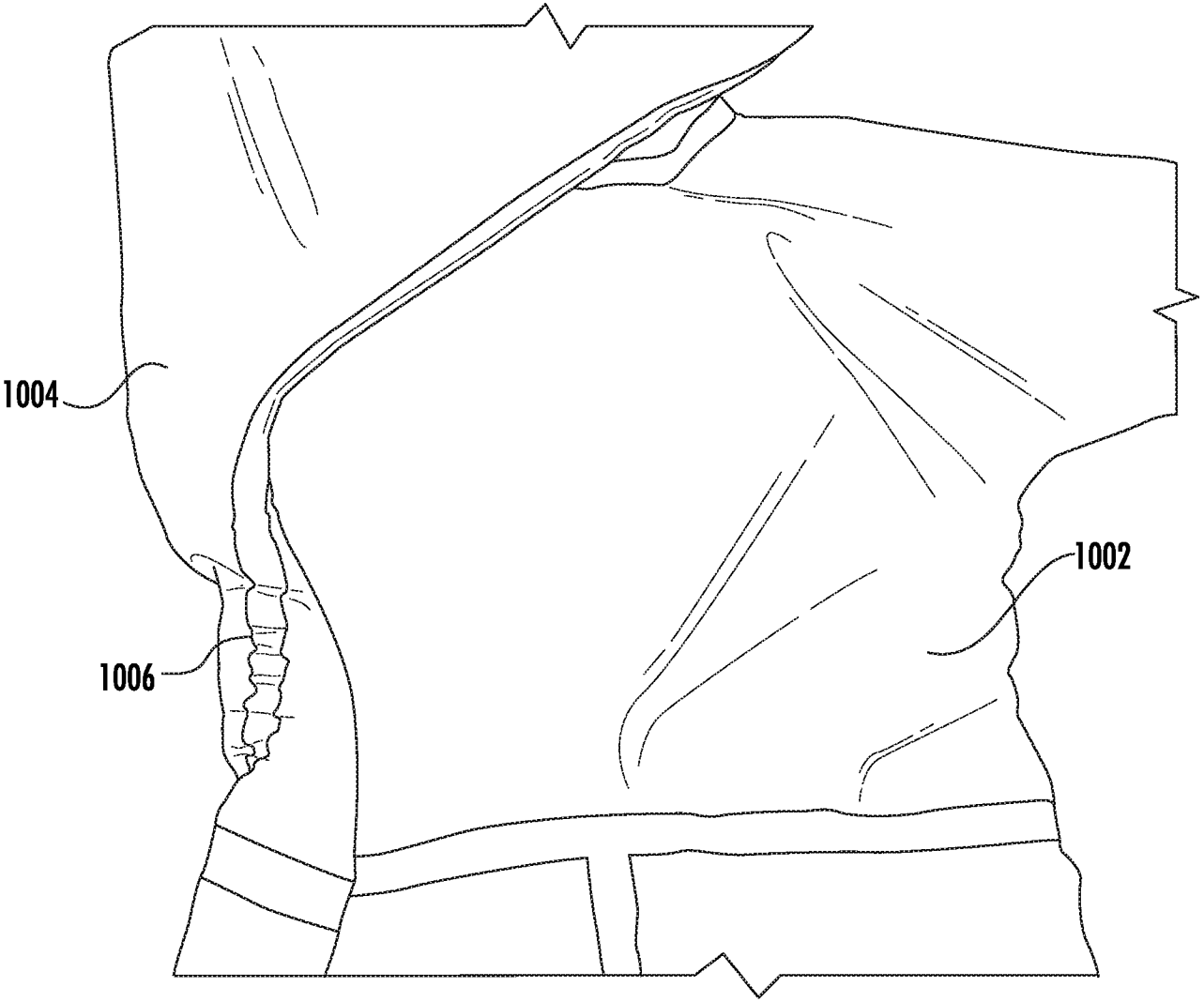
FIG. 10 illustrates an example front view of an example protective garment in accordance with examples of the present disclosure.

As such, various examples of the present disclosure may provide a protective garment that comprises a front segment and a back segment. The front segment and the back segment may be connected via a first shirring stitch seam that is formed based on a first side seam joining the first side edge and the second side edge. Additionally, or alternatively, the front segment and the back segment may be connected via a second shirring stitch seam that is formed based on a second side seam joining the third side edge and the fourth side edge. Referring now to FIG. 10, an example front view of an example protective garment that is manufactured in accordance with examples of the present disclosure are illustrated.

In the example shown in FIG. 10, the example protective garment may comprise a front segment 1002 and a back segment 1004, similar to the front segment 901 and the back segment 905 described above in connection with FIG. 9A, FIG. 9B, and FIG. 9C. The front segment 1002 and the back segment 1004 may be connected via a first shining stitch seam 1006, similar to the first shining stitch seam 934 described above in connection with FIG. 9A, FIG. 9B, and FIG. 9C.

By implementing shining techniques in manufacturing the protective garment, examples of the present disclosure may increase the chest and/or waist volume(s) of an example protective garment, without the use of additional chest darts and/or cut lines. As such, various examples of the present disclosure may provide a protective garment that may accommodate for these needs or requirements from wearers of different body shapes.

Many protective garments may be designed as a one-piece clothing. In such examples, a wearer may need to doff or take off at least half of the protective garment when using restroom, which may be time consuming and may increase the risk of exposure to airborne particulate matters (for example, viruses).

Figure 11A:
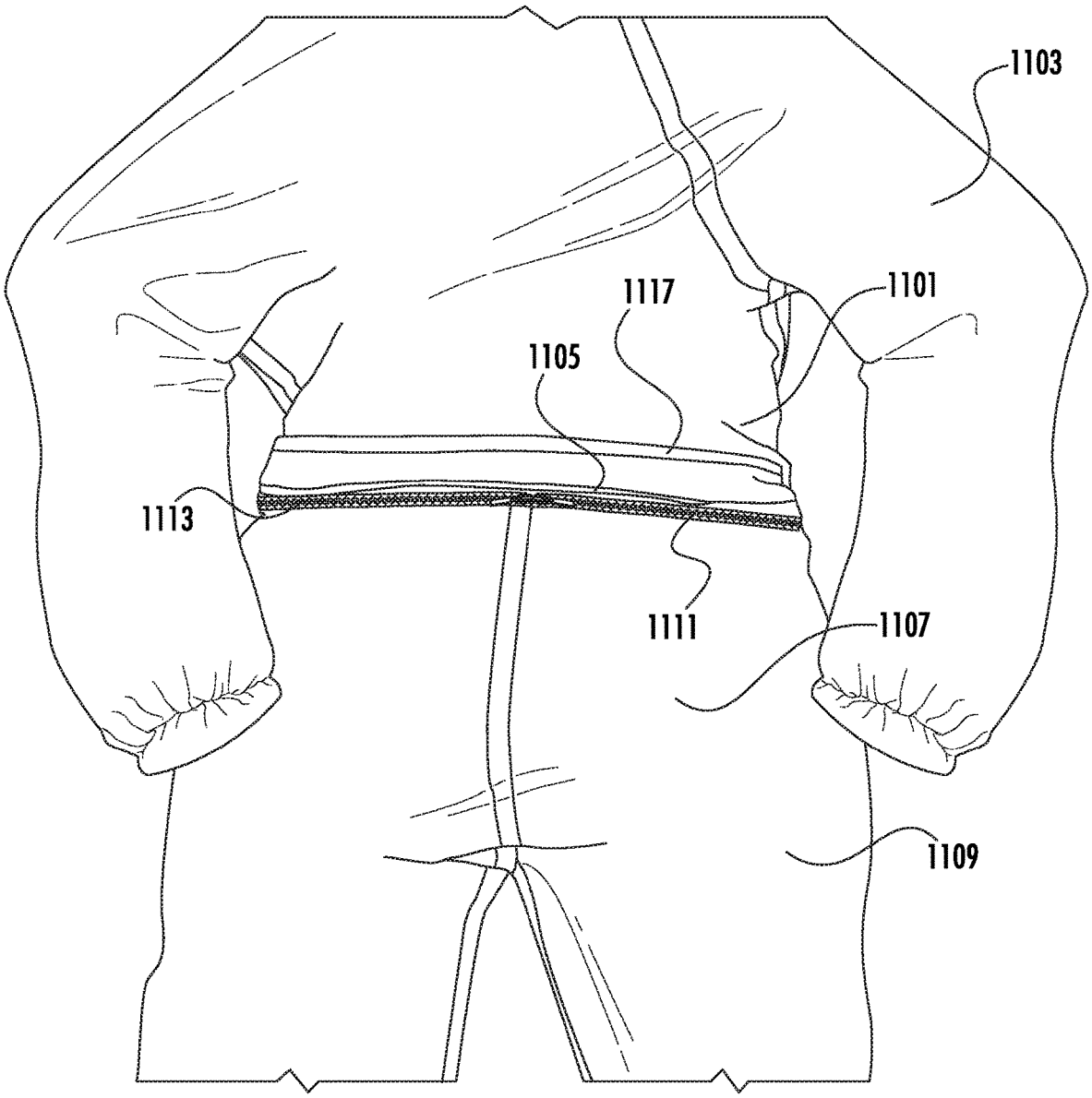
FIG. 11A, FIG. 11B, and FIG. 11C illustrate various example views of an example protective garment in accordance with examples of the present disclosure.
Figure 11B:
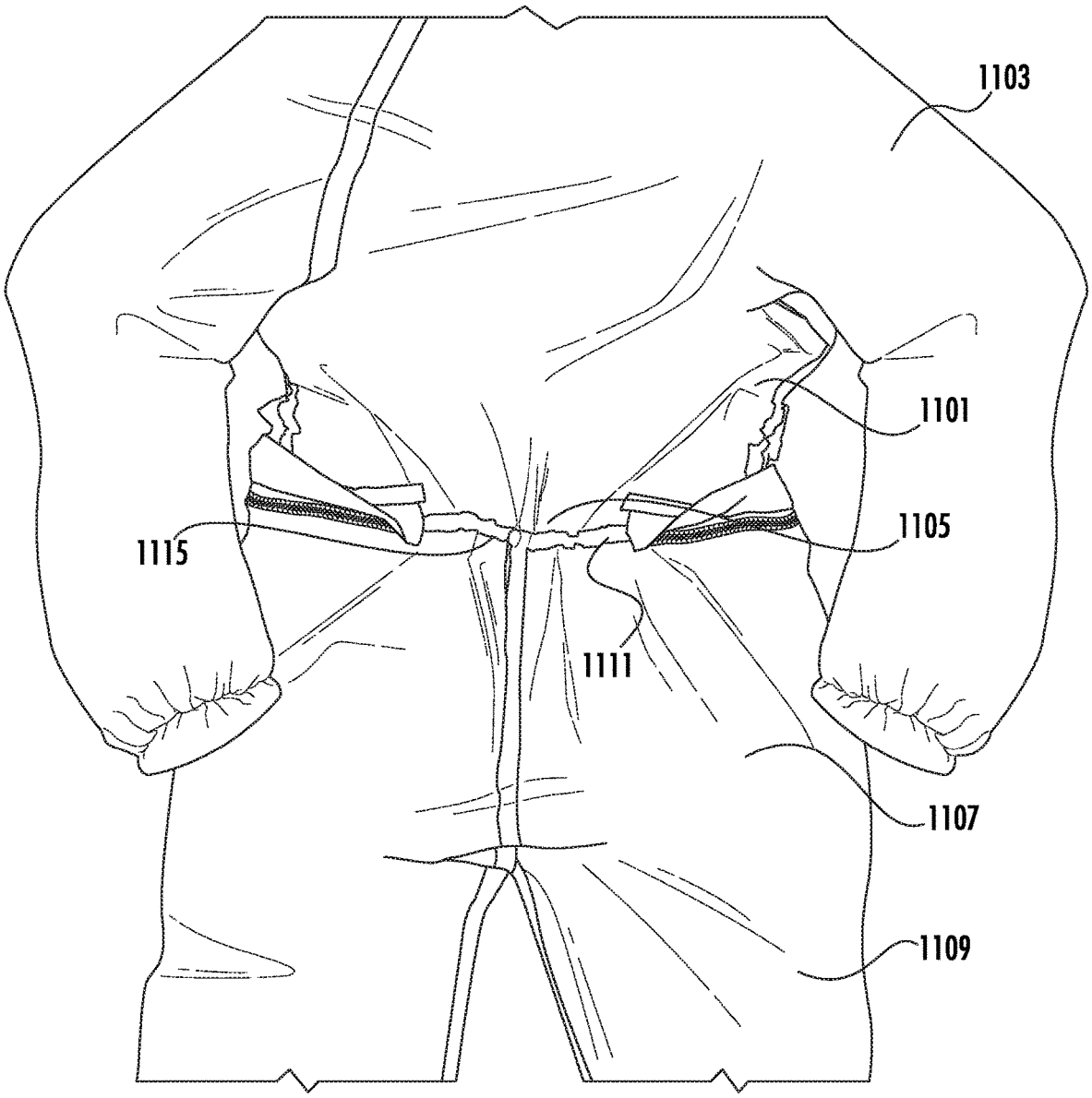
Figure 11C:
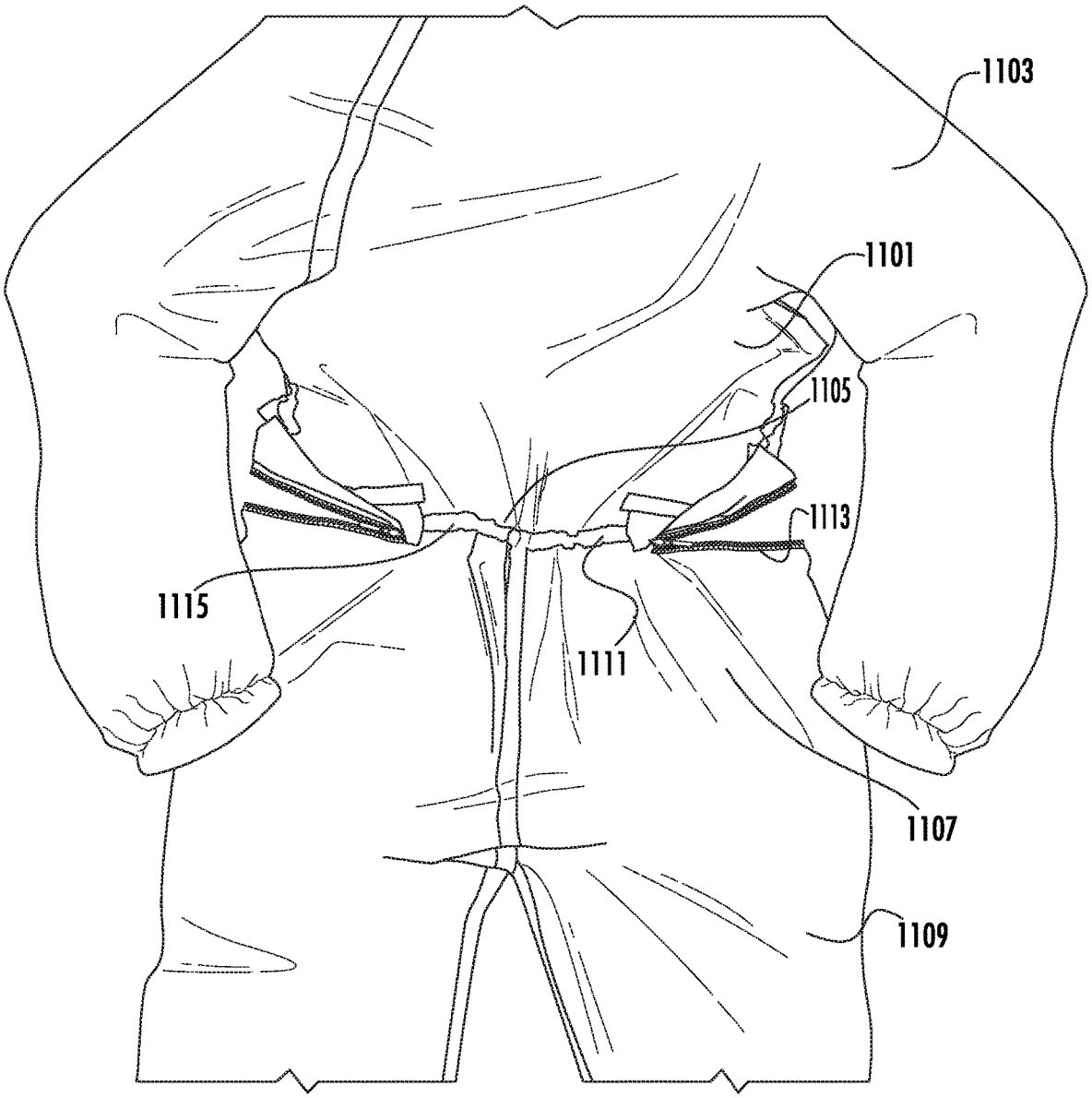

In accordance with various examples of the present discourse, a protective garment may provide accommodation for a wearer to use restroom. Referring now to FIGS. 11A, 11B, and 11C, example views of an example protective garment that is manufactured in accordance with examples of the present disclosure are illustrated. In particular, FIG. 11A illustrates an example back view of the protective garment, FIG. 11B illustrates an example front view of the protective garment, and FIG. 11C illustrates an example front view of the protective garment. Based on FIG. 11A, FIG. 11B, and FIG. 11C, an example method for manufacturing a protective garment may be provided.

Referring now to FIG. 11A, in some examples, the example method for manufacturing a protective garment may include providing an upper segment 1101.

In some examples, the upper segment 1101 may be configured to cover at least part of an upper torso of a wearer. For example, the upper segment 1101 may comprise at least one sleeve portion 1103, which may be configured to cover at least a portion of a wearer's arm.

In some examples, the upper segment 1101 may comprise a first waist edge 1105. When a wearer puts on an example protective garment that is manufactured in accordance with examples of the present disclosure, the first waist edge 1105 may be positioned on an upper waistline of the wearer.

In some examples, the example method for manufacturing a protective garment may include providing a lower segment 1107.

In some examples, the lower segment 1107 may be configured to cover at least part of a lower torso region of the wearer. For example, the lower segment 1107 may comprise at least one leg portion 1109, which may be configured to cover at least a portion of a wearer's leg.

In some examples, the lower segment 1107 may include a second waist edge 1111. When a wearer puts on an example protective garment that is manufactured in accordance with examples of the present disclosure, the second waist edge 1111 may be positioned on an lower waistline of the wearer.

In some examples, the example method for manufacturing a protective garment may include connecting the upper segment 1101 and the lower segment 1107 by at least one detachable fastening mechanism 1113.

As used herein, the term "detachable fastening mechanism" refers to one or more mechanisms that may be configured to provide two or more fastening state associated with two or more segments of a protective garment, such that these segments may attach to or detach from one another, and/or to join or separate from one another, as the detachable fastening mechanism translates between one state and another state.

For example, the at least one detachable fastening mechanism 1113 may comprise a zipper fastener. In some examples, the zipper fastener may connect at least a back portion of the first waist edge 1105 and at least a back portion of the second waist edge 1111. For example, the zipper fastener may comprise a first teeth row disposed along the first waist edge 1105, and a second teeth row disposed along the second waist edge 1111. In some examples, connecting the upper segment 1101 and the lower segment 1107 may further comprise connecting the first teeth row and the second teeth row via a slider of the zipper fastener. In some examples, the zipper fastener may comprise a two-way two-slider zipper.

Additionally, or alternatively, the at least one detachable fastening mechanism 1113 may comprise a hook-and-loop fastener. For example, a lineal fabric strip comprising hooks may be disposed along the first waist edge 1105, and a lineal fabric strip comprising loops may be disposed along the second waist edge 1111. As such, the hook-and-loop fastener may connect at least a back portion of the first waist edge 1105 and at least a back portion of the second waist edge 1111.

While the description above provides examples of detachable fastening mechanisms, it is noted that the scope of the present disclosure is not limited to the description above. In some examples, an example detachable fastening mechanism may comprise one or more additional and/or alternative elements.

Referring back to FIG. 11A, in some examples, the upper segment 1101 may comprise a flap portion 1117. In some examples, the flap portion 1117 may cover at least a portion of the at least one detachable fastening mechanism 1113. For example, the flap portion 1117 may extend from the first waist edge 1105.

In some examples, adhesive tapes may be disposed on an inner surface of the flap portion 1117, and the adhesive tapes may increase the seal level of the at least one nondetachable fastening mechanism 1115. Additionally, or alternatively, adhesive tapes may be disposed on one or both ends of the at least one nondetachable fastening mechanism 1115 to increase the seal level.

Referring now to FIG. 11B, an example front view of an example protective garment is provided. In the example shown in FIG. 11B, the upper segment 1101 and the lower segment 1107 may be connected by at least one nondetachable fastening mechanism 1115 on a front portion of the protective garment.

As used herein, the term "nondetachable fastening mechanism" refers to one or more mechanisms that may be configured to securely fasten two or more segments of a protective garment, such that these segments may not detach or separate from one another.

For example, the upper segment 1101 and the lower segment 1107 may be connected through sewing, and the nondetachable fastening mechanism 115 may comprise stitches and/or sealing tapes. While the description above provides examples of nondetachable fastening mechanism, it is noted that the scope of the present disclosure is not limited to the description above. In some examples, an example nondetachable fastening mechanism may comprise one or more additional and/or alternative elements.

Referring to FIG. 11C, an example front view of the protective garment is provided. As described above, the at least one nondetachable fastening mechanism 1115 may connect at least a front portion of the first waist edge 1105 and at least a front portion of the second waist edge 1111. The at least one detachable fastening mechanism 1113 may connect at least a back portion of the first waist edge 1105 and at least a back portion of the second waist edge 1111.

In some examples, one or both ends of the at least one detachable fastening mechanism 1113 may be located on a front portion of the first waist edge 1105 and/or a front portion of the second waist edge 1111. In some examples, the remaining front portion of the first waist edge 1105 and/or the remaining front portion of the second waist edge 1111 may be connected by the at least one nondetachable fastening mechanism 1115. As such, when a wearer wearing an example protective garment that is manufactured in accordance with examples of the present disclosure, the wearer may open or close the back portion of the protective garment (i.e. connect or disconnect the back portion of upper segment 1101 and the back portion of the lower segment 1107) when using restroom via the at least one detachable fastening mechanism 1113, while the front portion of the protective garment may be securely connected via the at least one nondetachable fastening mechanism 1115 (i.e. the front portion of the upper segment 1101 and the front portion of the lower segment 1107 may be securely connected).

For example, the wearer may slide a left slider of the two-way two-slider zipper to the left, and a right slider of the two-way two-slider zipper to the right. The left slider and the right slider may stop as they reach the nondetachable fastening mechanism 1115. In some examples, a length of the nondetachable fastening mechanism 1115 may be 15 centimeters. As such, the wearer may use the restroom without doffing or taking off the protective garment.

Continuing from the above example, after finishing using the restroom, the wearer may close the back portion of the protective garment by, for example, sliding the left slider to the right and right slider to the left until the two sliders meet.

As such, various examples of the present disclosure may provide a protective garment that may comprise an upper segment and a lower segment. At least a front portion of the upper segment and at least front portion of lower segment may be connected via nondetachable fastening mechanism, and at least a back portion of the upper segment and at least a back portion of the lower segment may be connected via detachable fastening mechanism.

The donning process and doffing process of many protective garments are complex and time-consuming, and the comfort levels of the donning process and doffing process are low. As described above, many protective garments may comprise a middle line seam or zipper on the front portion of the upper segment (for example, covering the chest region of the wearer) and a middle line seam or zipper on the back portion of the upper segment (for example, covering the back region of the wearer). When a wearer is donning or doffing the protective garment, the wearer may need to stand on one foot in one or more instances, which can be uncomfortable to the wearer and may risk falling over.

For example, in a donning process, the wearer may need to pull the protective garment from lower torso portion (for example, leg portions) up to upper torso portion (for example, chest portion), pull the cuff up and arrange the cuff position, and pull the middle line zipper(s) up to the top (and adjust the sealing level of the hood portion). In a doffing process, the wearer may need to unzip and lower the middle line zipper(s), pull the hood portion up and back to roll the protective garment from the upper torso portion down to the lower torso portion. When rolling the protective garment down, the wearer may need to stand on one foot to allow the other foot to be removed from the leg opening of the protective garment.

Figure 12A:
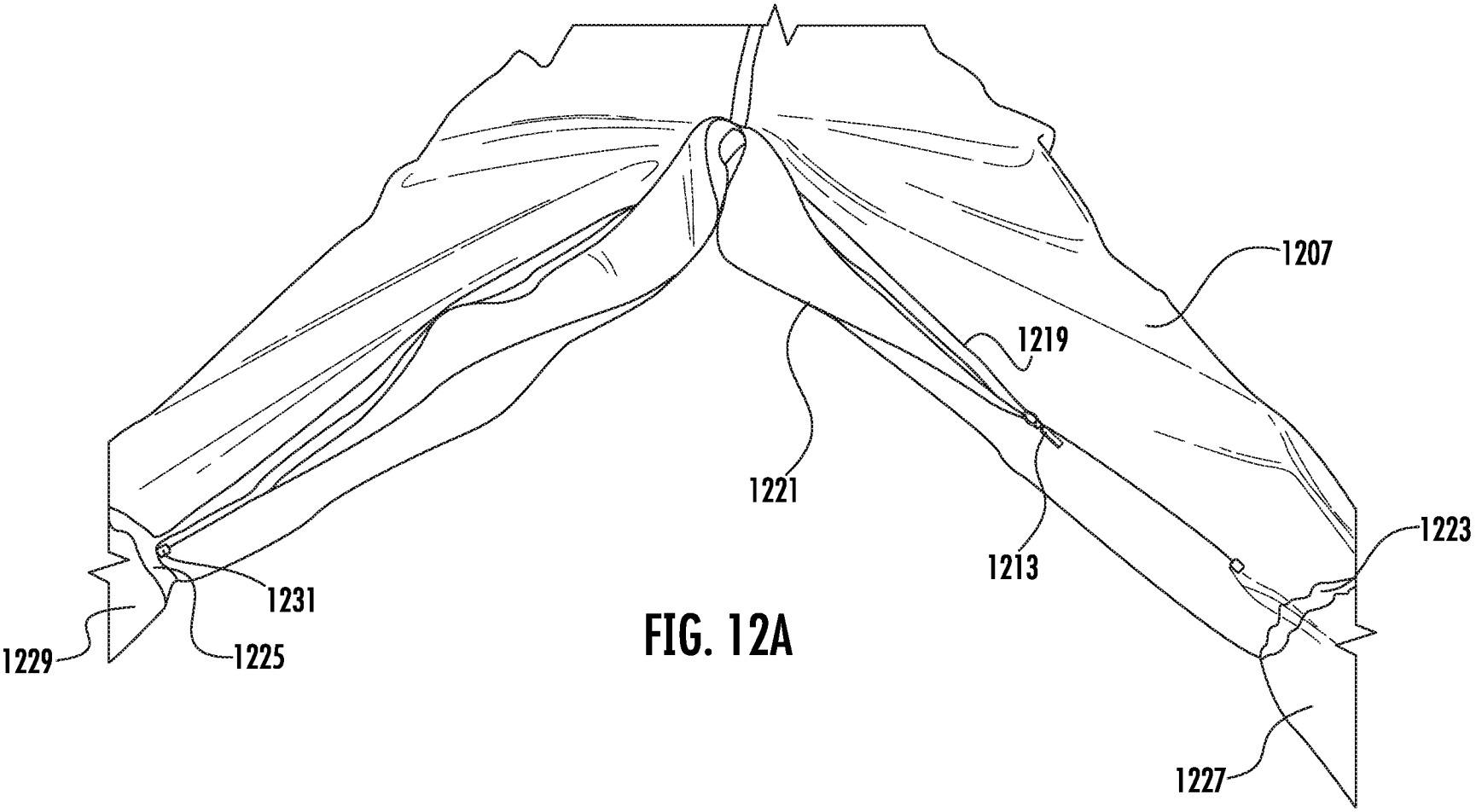
FIG. 12A illustrates an example view of an example lower segment of an example protective garment in accordance with examples of the present disclosure.

In accordance with various examples of the present disclosure, a protective garment may reduce steps of donning and/or doffing process as compared to the example above. For example, the protective garment may eliminate the need to stand on one foot during the donning and/or doffing process. Referring now to FIG. 12A, an example view illustrating an example lower segment 1207 of a protective garment is illustrated. Based on the example view of FIG. 12A, an example method for manufacturing a protective garment may be provided.

In some examples, the example method for manufacturing a protective garment may comprise providing a lower segment 1207. In some examples, the lower segment 1207 may be configured to cover at least part of a lower torso region of a wearer (for example, at least a part of a leg portion the wearer).

In some examples, the lower segment 1207 may comprise a first inseam edge 1219 and a second inseam edge 1221. As used herein, the term "inseam edge" refers to an edge of a segment of a protective garment that may be located on an inner leg portion of a wearer when the protective garment is worn by the wearer.

In some examples, the first inseam edge 1219 and the second inseam edge 1221 may each correspond to a front or back portion of the lower segment 1207. For example, the first inseam edge 1219 may correspond to a front portion of the lower segment 1207, and the second inseam edge 1221 may correspond to a back portion of the lower segment 1207.

In some examples, the example method for manufacturing a protective garment may comprise forming at least one leg portion by connecting the first inseam edge 1219 and the second inseam edge 1221 via at least one detachable fastening mechanism 1213.

Similar to the at least one detachable fastening mechanism 1113 described above in connection with FIG. 11A, FIG. 11B, and FIG. 11C, the at least one detachable fastening mechanism 1213 may comprise a zipper fastener. For example, the zipper fastener may comprise a first teeth row disposed along the first inseam edge 1219 and a second teeth row disposed along the second inseam edge 1221. In some examples, connecting the first inseam edge 1219 and the second inseam edge 1221 may comprise connecting the first teeth row and the second teeth row via a slider of the zipper fastener.

In some examples, the zipper fastener may comprise a one-slider zipper. In some examples, the zipper fastener may comprise a two-way two-slider zipper. In some examples, other types of zippers may be used.

Additionally, or alternatively, the at least one detachable fastening mechanism 1213 may comprise a hook-and-loop fastener, similar to these described above in connection with FIG. 11A, FIG. 11B, and FIG. 11C.

While the description above provides examples of detachable fastening mechanisms, it is noted that the scope of the present disclosure is not limited to the description above. In some examples, an example detachable fastening mechanism may comprise one or more additional and/or alternative elements.

Referring back to FIG. 12A, in some examples, the example manufacturing process may include forming two leg portions by connecting the first inseam edge 1219 and the second inseam edge 1221 via the at least one detachable fastening mechanism 1213.

Continuing from the zipper fastener example, the zipper fastener may be positioned on the inseam line of the protective garment. The zipper fastener may begin at one inseam end of one leg portion of the protective garment, and may end at one inseam end of the other leg portion of the protective garment. As such, the zipper fastener may allow a wearer to open the protective garment from one end of one leg portion to one end of the other leg portion, such that a wearer may put his or her body through the opening during donning process and doffing process.

Figure 13B:
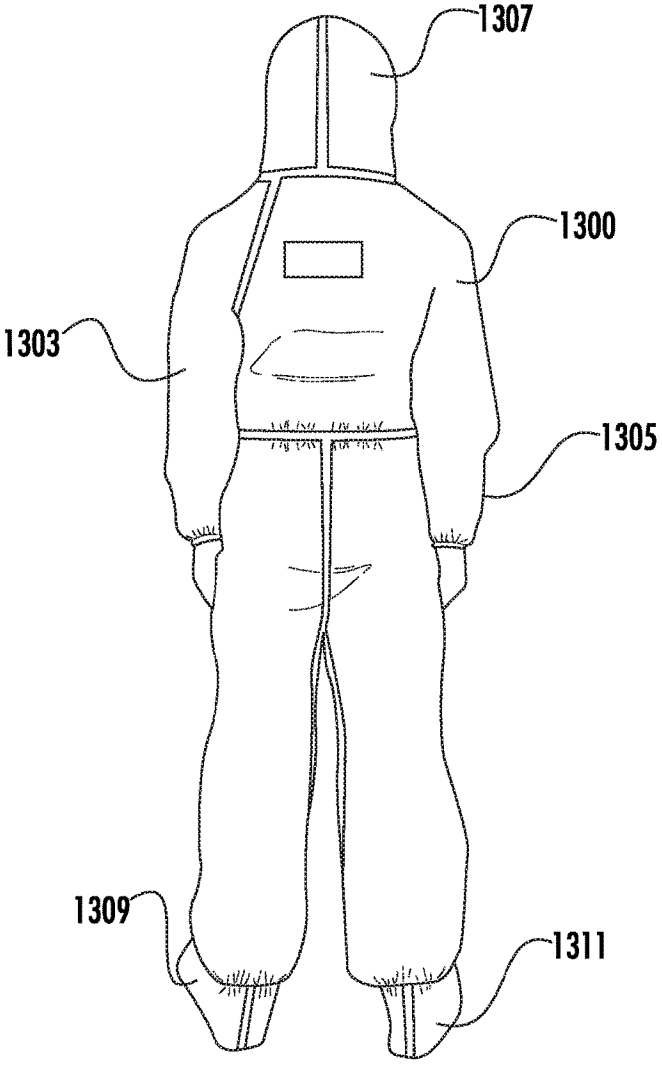
FIG. 13A and FIG. 13B illustrate example views of an example protective garment in accordance with examples of the present disclosure.
Figure 13A:
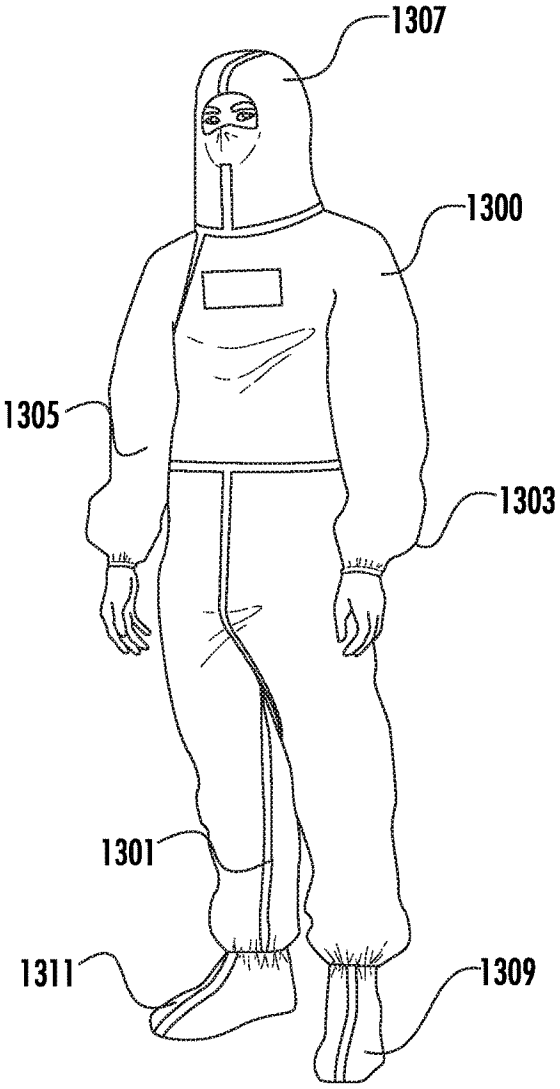

As will be further discussed and illustrated in FIG. 13A and FIG. 13B, in some examples, one or both leg portions of the protective garment may be connected to a shoe portion of the protective garment. For example, an edge of the leg portion may be connected to an edge of the shoe portion through one or more connection mechanisms discussed herein, and may form, for example, an ankle seam. For example, an edge of a leg portion of the lower segment 1207 may be connected to the first shoe portion 1227 and form the first ankle seam 1223. Additionally, or alternatively, an edge of a leg portion of the lower segment 1207 may be connected to the second shoe portion 1229 and form the second ankle seam 1225. In such examples, one or both ends of the at least one detachable fastening mechanism 1213 may be positioned at the first ankle seam 1223 and/or the second ankle seam 1225.

For example, the zipper fastener may comprise a first teeth row disposed along the first inseam edge 1219, and a second teeth row disposed along the second inseam edge 1221. The first teeth row may begin at the first ankle seam 1223 and end at the second ankle seam 1225. Additionally, or alternatively, the second teeth row may begin at the first ankle seam 1223 and end at the second ankle seam 1225. In some examples, the zipper fastener may comprise a bottom stop 1231 that may securely connect one end of the first inseam edge 1219 and/or the second inseam edge 1221 at or near the first ankle seam 1223 and/or the second ankle seam 1225. In such examples, the zipper fastener may stop at the bottom stop 1231 and may not open up the shoe portion(s) of the protective garment due to the bottom stop 1231.

Figure 12B:
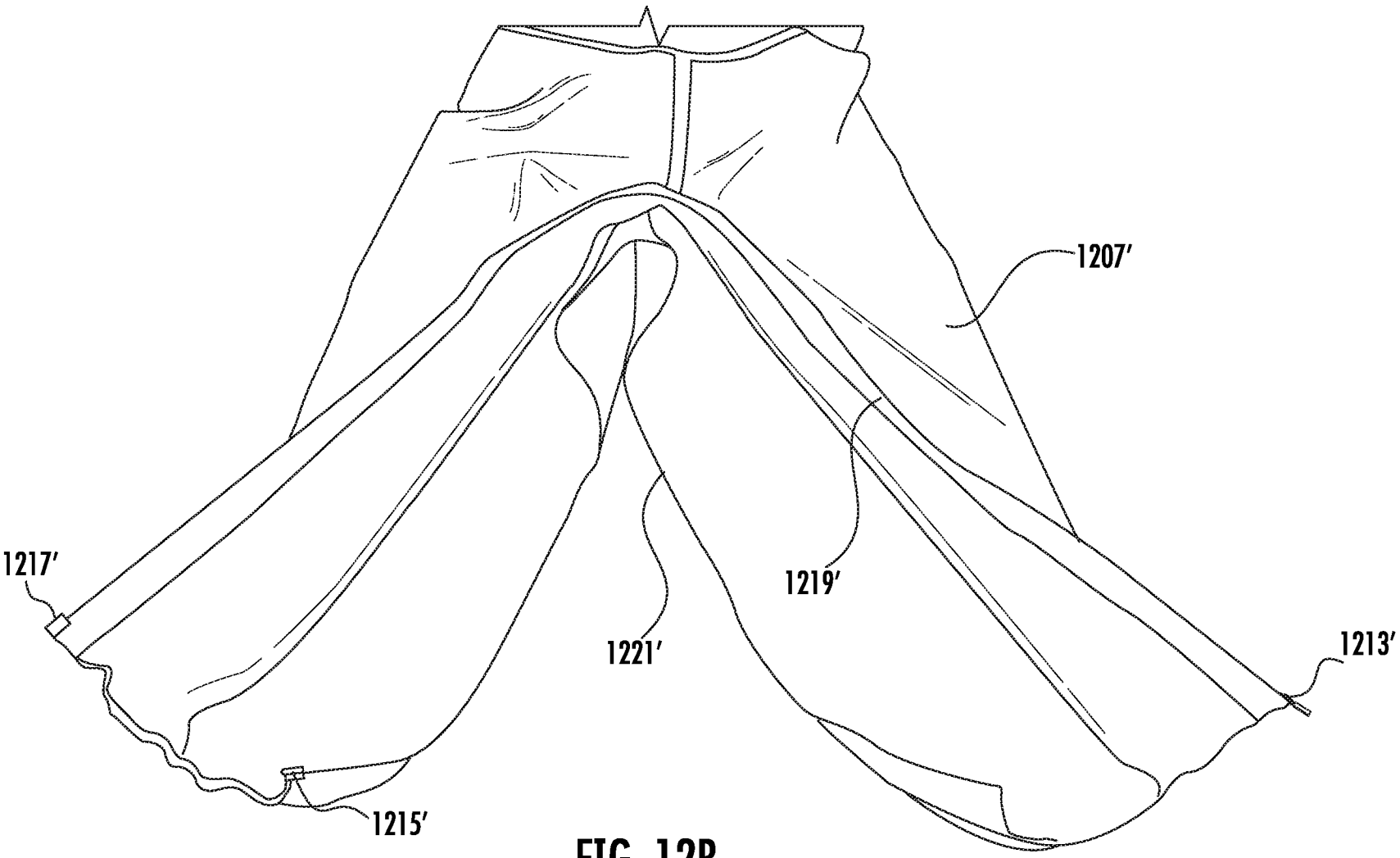
FIG. 12B illustrates an example view of an example lower segment of an example protective garment in accordance with examples of the present disclosure.

Referring now to FIG. 12B, an example view illustrating an example lower segment 1207' of a protective garment is illustrated. Based on the example view of FIG. 12B, an example method for manufacturing a protective garment may be provided.

In some examples, the example method for manufacturing a protective garment may comprise providing a lower segment 1207'. In some examples, the lower segment 1207' may be configured to cover at least part of a lower torso region of a wearer (for example, at least a part of a leg portion the wearer).

In some examples, the lower segment 1207' may comprise a first inseam edge 1219' and a second inseam edge 1221'. In some examples, the first inseam edge 1219' and the second inseam edge 1221' may each correspond to a front or back portion of the lower segment 1207'. For example, the first inseam edge 1219' may correspond to a front portion of the protective garment, and the second inseam edge 1221' may correspond to a back portion of the lower segment 1207'.

In some examples, the example method for manufacturing a protective garment may comprise forming at least one leg portion by connecting the first inseam edge 1219' and the second inseam edge 1221' via at least one detachable fastening mechanism 1213'.

Similar to the at least one detachable fastening mechanism 1113 described above in connection with FIG. 11A, FIG. 11B, and FIG. 11C, the at least one detachable fastening mechanism 1213' may comprise a zipper fastener. For example, the zipper fastener may comprise a first teeth row disposed along the first inseam edge 1219' and a second teeth row disposed along the second inseam edge 1221'. In some examples, connecting the first inseam edge 1219' and the second inseam edge 1221' may comprise connecting the first teeth row and the second teeth row via a slider of the zipper fastener.

In some examples, the zipper fastener may comprise a one-slider zipper. In some examples, the zipper fastener may comprise a two-way two-slider zipper. In some examples, other types of zippers may be used.

Additionally, or alternatively, the at least one detachable fastening mechanism 1213' may comprise a hook-and-loop fastener, similar to these described above in connection with FIG. 11A, FIG. 11B, and FIG. 11C.

While the description above provides examples of detachable fastening mechanisms, it is noted that the scope of the present disclosure is not limited to the description above. In some examples, an example detachable fastening mechanism may comprise one or more additional and/or alternative elements.

Referring back to FIG. 12B, in some examples, the example manufacturing process may include forming two leg portions by connecting the first inseam edge 1219' and the second inseam edge 1221' via the at least one detachable fastening mechanism 1213'.

Continuing from the zipper fastener example, the zipper fastener may be positioned on the inseam line of the lower segment 1207'. The zipper fastener may begin at one inseam end of one leg portion of the protective garment, and may end at one inseam end of the other leg portion of the lower segment 1207'.

In some examples, the zipper fastener may comprise an insertion pin disposed on one end of the first inseam edge 1219' and/or on one end of the second inseam edge 1221' at one leg portion, and may comprise a retainer box disposed on one end of the second inseam edge 1221' and/or on one end of the first inseam edge 1219', respectively, at the same leg portion. For example, the insertion pin 1215' may be disposed on the second inseam edge 1221', and the retainer box 1217' may be disposed on the first inseam edge 1219'.

In some examples, the insertion pin may be inserted to the retainer box to connect the first inseam edge 1219' and the second inseam edge 1221', and may be removed from the retainer box to disconnect the first inseam edge 1219' from the second inseam edge 1221'. As such, the zipper fastener may allow a wearer to open the protective garment from one end of one leg portion to one end of the other leg portion, such that a wearer may put his or her body through the opening during donning process and doffing process.

Figure 13D:
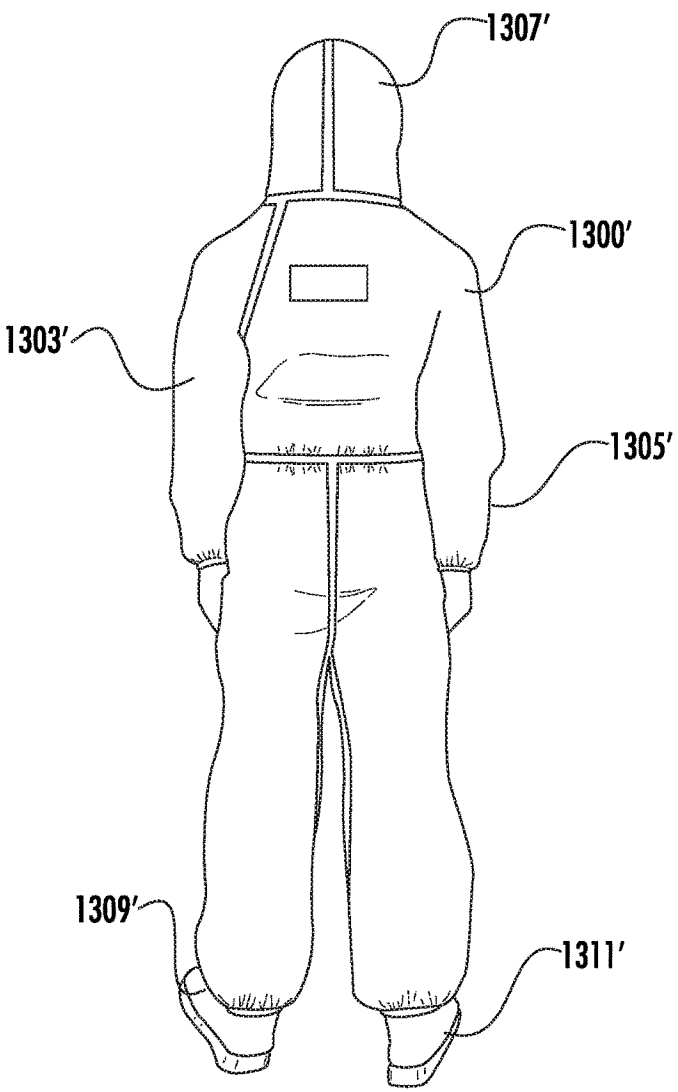
FIG. 13C and FIG. 13D illustrate example views of an example protective garment in accordance with examples of the present disclosure.
Figure 13C:
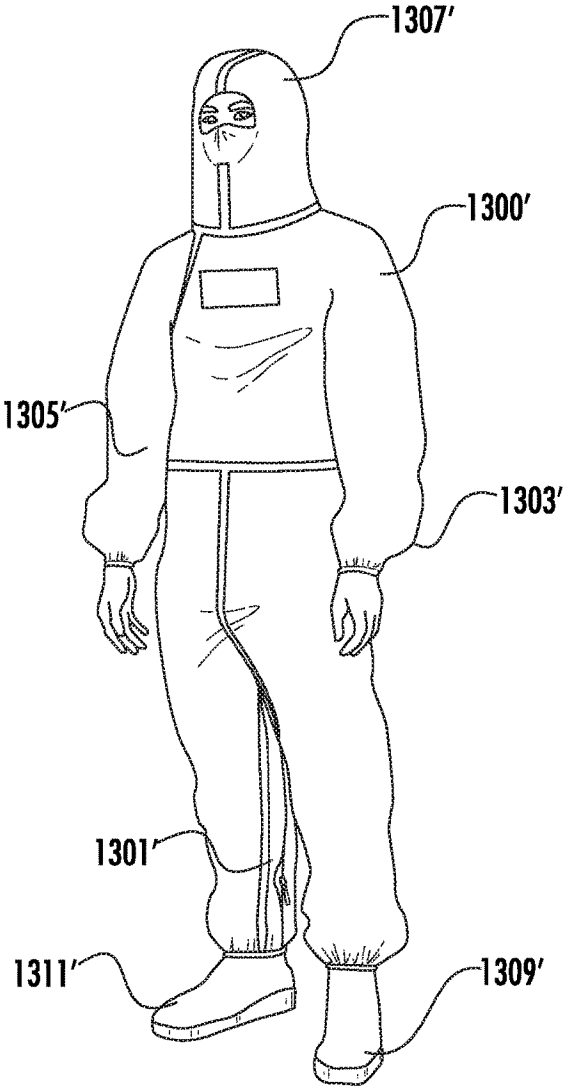

As will be further discussed and illustrated in FIG. 13C and FIG. 13D, in some examples, one or both leg portions of the protective garment may not be connected to a shoe portion of the protective garment. For example, the first shoe portion 1227 and/or the second shoe portion 1229 of FIG. 12A may be detached from the lower segment 1207 of FIG. 12A. Referring to FIG. 12B, one or both ends of the at least one detachable fastening mechanism 1213' may be positioned at one or more ends of the first inseam edge 1219' and/or the second inseam edge 1221'.

Continuing from the zipper fastener example above, the zipper fastener may comprise a first teeth row disposed along the first inseam edge 1219', and a second teeth row disposed along the second inseam edge 1221'. The first teeth row may begin at the first end of the first inseam edge 1219' and end at the second end of the first inseam edge 1219'. Additionally, or alternatively, the second teeth row may begin at the first end of the second inseam edge 1221' and end at the second end of the second inseam edge 1221'. In such examples, the zipper fastener may open up foot opening(s) of the lower segment 1207', as shown in FIG. 12B.

For example, the at least one detachable fastening mechanism 1213' may comprise a one-slider zipper that may slide from one end of one inseam line of one leg portion to one end of another inseam line of another leg portion, such that leg portions may open and close as the one-slider zipper opens and closes. For example, to open the leg portion, a wearer may slide the slider of the zipper towards the insertion pin and retainer box of the zipper (for example, the insertion pin 1215' and the retainer box 1217' as shown in FIG. 12B), and may remove the insertion pin from the retainer box to open the leg portion. To close the leg portion, a wearer may insert the insertion pin (for example, the insertion pin 1215') to the retainer box (for example, the retainer box 1217'), and may slide the slider of the zipper.

Referring now to FIG. 13A and FIG. 13B, example views of an example protective garment 1300 in accordance with examples of the present disclosure are shown. In some examples, the example protective garment 1300 may comprise a shoe portion 1311 and a shoe portion 1309.

During an example donning process, a wearer may open the at least one detachable fastening mechanism 1301, and may pull the protective garment from upper torso portion (for example, chest portion) down to the lower torso portion (for example, leg portions). The wearer may put his or her arms through the first sleeve portion 1305 and the second sleeve portion 1303. The wearer may pull the hood portion 1307 up to cover the head.

As described above, the protective garment may comprise shoe portions 1309 and 1311. In such examples, the wearer may put his or her feet into the shoe portions 1309 and 1311. Subsequently, the wearer may close the protective garment 1300 by closing the at least one detachable fastening mechanism 1301 (for example, closing the zipper fastener disposed along the inseam line of the leg portions of the protective garment 1300).

During an example doffing process, a wearer may open the at least one detachable fastening mechanism 1301 (for example, unzip the zipper fastener from one long portion to another leg portion). The wearer may pull his or her feet from the shoe portions 1309 and 1311 (or from leg openings of the protective garment). The wearer may roll the protective garment 1300 from the lower torso portion up to the upper torso portion. The wearer may pull up the hood portion 1307, and may remove the protective garment 1300.

Referring now to FIG. 13C and FIG. 13D, example views of an example protective garment 1300' in accordance with examples of the present disclosure are shown. In some examples, the example protective garment 1300' may not comprise any shoe portion. In such examples, the shoe portion 1311' and the shoe portion 1309' may not be connected to and/or be separated from the protective garment 1300'.

During an example donning process, a wearer may open the at least one detachable fastening mechanism 1301', and may pull the protective garment from upper torso portion (for example, chest portion) down to the lower torso portion (for example, leg portions). The wearer may put his or her arms through the first sleeve portion 1305' and the second sleeve portion 1303'. The wearer may pull the hood portion 1307' up to cover the head.

As described above, the protective garment 1300' may not comprise the shoe portion 1309' and the shoe portion 1311'. The wearer may close the protective garment by closing the at least one detachable fastening mechanism 1301'. Prior to or subsequent to closing the at least one detachable fastening mechanism 1301', the wearer may put on the shoe portion 1311' and the shoe portion 1309'.

As described above, the at least one detachable fastening mechanism 1301' may comprise a one-slider zipper that may slide from one end of one inseam line of one leg portion to one end of another inseam line of another leg portion, such that foot opening portions may open and close as the one-slider zipper opens and closes. For example, when the wearer opens the at least one detachable fastening mechanism 1301' during an example donning process, the wearer may slide the one-slider zipper from one end of one inseam line of one leg portion to one end of another inseam line of another leg portion. After the wearer pulls the protective garment from the upper torso portion down to the lower torso portion, the wearer may close the one-slider zipper from one end of one inseam line of one leg portion to one end of the other inseam line of the other leg portion (for example, inserting the insertion pin to the retainer box and sliding the slider as discussed above).

During an example doffing process, a wearer may open the at least one detachable fastening mechanism 1301' (for example, unzip the zipper fastener from one long portion to another leg portion). For example, the wearer may slide the slider and remove the insertion pin from the retainer box as discussed above. The wearer may roll the protective garment 1300' from the lower torso portion up to the upper torso portion. The wearer may pull up the hood portion 1307', and may remove the protective garment 1300'.

As such, examples of the present disclosure may provide improvements on the donning process and doffing process of a protective garment. For example, various examples of the present disclosure may provide a protective garment that comprises a lower segment that comprises a first inseam edge and a second inseam edge. The first inseam edge and the second inseam edge may be connected via at least one detachable fastening mechanism. Through implementing at least one detachable fastening mechanism, examples of the present disclosure may improve the speed of donning process and doffing process and/or increase the comfort levels of the donning process and doffing process.

Many garments (for example, but not limited to, protective garments) may be made of material(s) that have low moisture permeability characteristics. As a result, wearers of these garments may experience discomfort after wearing the garment for a long period of time. In some examples, these garments may comprise microporous structured materials. However, the moisture permeability of such material may not be sufficient compared to the moisture generated by human body. In some examples, the moisture permeability of the protective garment may be limited in order to balance the need for protection.

For example, fabric materials for protective garments may include, but not limited to, spunbond meltblown spunbond (SMS), spunbond meltblown meltblown spunbond (SMMS), spunbond spunbond meltblown spunbond (SSMS), spunbond meltblown meltblown meltblown meltblown spunbond (SMMMMS) and/or spunbond laminated polyethylene/thermoplastic polyurethane (PE/TPU) film. However, there is no water absorb layer within such materials. Further, there is no functional layer to propel the moisture from an inner surface of the protective garment to an outer surface of the protective garment.

Figure 14:
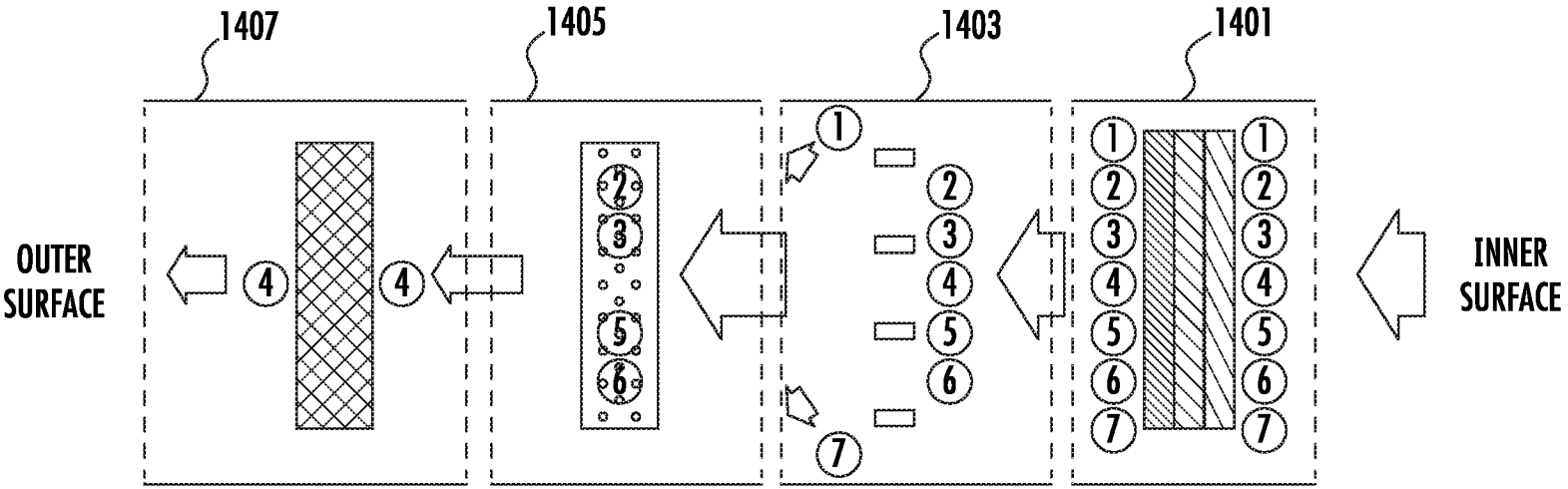
FIG. 14 illustrates an example diagram showing an example structure of an example material in accordance with examples of the present disclosure.

Referring now to FIG. 14, an example diagram illustrating an example structure of an example material is shown. In some examples, the material illustrated and described in connection with FIG. 14 may be implemented in a variety of products, including but not limited to, PPE products (such as, but not limited to, protective garments).

In some examples, the example material may comprise multiple layers of nonwoven materials. In the example shown in FIG. 14, the example material may comprise four layers from an inner surface (which may correspond to, for example but not limited to, an inner surface of a protective garment) to an outer surface (which may correspond to, for example but not limited to, an outer surface of a protective garment): a vapor transfer layer 1401, a vapor venting layer 1403, a water absorption layer 1405, and a filming and/or coating layer 1407.

In some examples, the vapor transfer layer 1401 may has a low affinity to water and/or may be non-water absorbent. When the example material is implemented for garment manufacturing, the vapor transfer layer 1401 may be in contact with the wearer of the garment. As such, the hydrophobic material of the vapor transfer layer 1401 may allow the wearer to feel dry when touching the garment.

In some examples, the vapor transfer layer 1401 may comprise nonwoven fabric. For example, the nonwoven fabric may be formed based on one or more processes as discussed above (for example, a spinning process). In some examples, the vapor transfer layer 1401 may comprise hydrophobic material. For example, the vapor transfer layer 1401 may comprise polypropylene nonwoven fabric and/or polyethylene nonwoven fabric. Additionally, or alternatively, the vapor transfer layer 1401 may comprise other type(s) of material(s).

In some examples, the vapor transfer layer 1401 may comprise hollow portions between fibers of nonwoven fabric. The hollow portions may allow vapor and moisture to transfer to the next layer. For example, the fibers of the nonwoven fabric of the vapor transfer layer 1401 may form a curled cross section, which may create channels for vapor transfer.

In some examples, the vapor transfer layer 1401 may comprise multiple sub-layers. In the example shown in FIG. 14, each sub-layer may have a different density level of fiber and/or a different size of the hollow portions between fibers. For example, a sub-layer closer to the inner surface may have a lower density level of fibers (and correspondingly larger hollow portion) as compared to that of a sub-layer that is further away from the inner surface. As such, vapor molecules may be transferred from the inner surface to the next layer. In the example shown in FIG. 14, vapor molecules 1-7 may be transferred from the vapor transfer layer 1401 to the vapor venting layer 1403.

In some examples, the vapor venting layer 1403 may be disposed on top of the vapor transfer layer 1401. For example, the vapor venting layer 1403 may be attached to the vapor transfer layer 1401 through the application of heat and/or pressure. Additionally, or alternatively, the vapor venting layer 1403 and the vapor transfer layer 1401 may be bonded and/or joined through other means including, but not limited to, chemical adhesive (such as, but not limited to, a polymeric adhesive).

In some examples, the vapor venting layer 1403 may comprise nonwoven fabric. For example, the nonwoven fabric may be formed based on one or more processes as discussed above (for example, a spinning process). For example, at least a portion of the vapor venting layer 1403 may comprise nonwoven fabric that may be constructed through a bonding process (for example a vertical bonding process) such that the vapor venting layer 1403 may be hydrophilic. For example, rubber patches and/or dewdrops may be applied during the bonding process. As an example, they may be added to the nonwoven fabric in a liquid state, which may transfer into a solid state as temperature drops. Additionally, or alternatively, other form(s) of bonding may be implemented.

In some examples, the nonwoven fabric that is constructed through the bonding process may be a center sub-layer of the vapor venting layer 1403. In these examples, one or more sub-layers comprising nonwoven fabric with hollow portions may be disposed between the center sub-layer and the vapor transfer layer 1401, and/or one or more sub-layers comprising nonwoven fabric with hollow portions may be positioned between the center sub-layer and the water absorption layer 1405. As such, vapor molecules may be attracted or propelled from the vapor transfer layer 1401 by the center sub-layer that is constructed through an example vertical bonding process, and may be vented out through venting spaces created by the hollow portions of sub-layer(s) neighboring the center sub-layer. In the example shown in FIG. 14, vapor molecules 1 and 7 may be vented out.

Additionally, or alternatively, the vapor venting layer 1403 may comprise hydrophilic material. Such materials may include, but not limited to, fiber/microfiber, sodium polyacrylate, and/or other material that may have a high affinity to water and/or may be water absorbent. In such examples, the vapor venting layer 1403 may drive vapor and/or moisture molecules to the water absorption layer 1405.

In some examples, the water absorption layer 1405 may be disposed on top of the vapor venting layer 1403. For example, the water absorption layer 1405 may be attached to the vapor venting layer 1403 through the application of heat and/or pressure. Additionally, or alternatively, the water absorption layer 1405 and the vapor venting layer 1403 may be bonded and/or joined through other means including, but not limited to, an chemical adhesive (such as, but not limited to, a polymeric adhesive).

In some examples, the water absorption layer 1405 may comprise nonwoven fabric. For example, the nonwoven fabric may be formed based on one or more processes as discussed above (for example, a spinning process). In some examples, the water absorption layer 1405 may comprise water absorption material. In some examples, the water absorption material may absorb moisture from the vapor venting layer 1403 without causing moisture flowback to the vapor venting layer 1403. Example water absorption material may include, but not limited to, fiber/microfiber, polyacrylic particles and/or polyacrylic fiber mixed materials (for example, sodium polyacrylate), and/or like. In the example shown in FIG. 14, the water absorption layer 1405 may absorb vapor molecules 2, 3, 5, and 6.

In some examples, the water absorption layer 1405 may comprise a mixture of water absorption material and nonwoven material. In some examples, the water absorption material may be fixed between fibers of the nonwoven material through chemical and/or mechanical means. For example, polyacrylic particles and/or polyacrylic fiber mixed materials may be fixed between fibers of the nonwoven material in the water absorption layer 1405.

In some examples, the water absorption layer 1405 may comprise antimicrobial material. Example antimicrobial material may include, but not limited to, silver ions, silver zeolite, silver zinc zeolite, silver copper zeolite, silver $SiO_2$, zinc pyrithione, quaternary ammonium compound, guanidine compound and/or other types compound(s).

In some examples, the filming and/or coating layer 1407 may be disposed on top of the water absorption layer 1405. For example, the filming and/or coating layer 1407 may be attached to the water absorption layer 1405 through the application of heat and/or pressure. Additionally, or alternatively, the filming and/or coating layer 1407 and the water absorption layer 1405 may be bonded and/or joined through other means including, but not limited to, an chemical adhesive (such as, but not limited to, a polymeric adhesive).

In some examples, the filming and/or coating layer 1407 may be exposed to an outer surface, and therefore may provide a barrier property to prevent, for example, environmental contaminations from entering into the garment. In some examples, the filming and/or coating layer 1407 may comprise nonwoven fabric.

In some examples, the filming and/or coating layer 1407 may comprise a filming layer (for example, microporous film). Additionally, or alternatively, the filming and/or coating layer 1407 may comprise a coating layer.

For example, the filming and/or coating layer 1407 may comprise climate change materials. The term "climate change material" refers to a material, compound, and/or substance that may have different structure(s), characteristic(s), and/or property/properties as the environmental temperature changes. For example, the filming and/or coating layer 1407 may comprise microporous film, and the pore size of the microporous film may be change as the environmental temperature changes. Additionally, or alternatively, the filming and/or coating layer 1407 may comprise material(s) with low melting point added into the baseline fabric, so that the filming and/or coating layer 1407 may absorb heat when environmental temperature increases. Additionally, or alternatively, other climate change material(s) may be implemented.

Additionally, or alternatively, the filming and/or coating layer 1407 may comprise antimicrobial materials. Such material may include, but not limited to, silver ions, silver zeolite, silver zinc zeolite, silver copper zeolite, silver $SiO_2$, zinc pyrithione, quaternary ammonium compound, guanidine compound and/or other types compound(s).

As such, various examples of the present disclosure may provide material for garment and other type(s) of personal protection equipment that may propel moisture/water out of garment/PPE, which may, for example, increase the comfort level of wearer of the garment/PPE.

While FIG. 14 and the above description illustrate example materials for protective garment, it is noted that example materials of the present disclosure may be implemented in products other than protective garments. For example, example materials of the present disclosure may be implemented in other type(s) of personal protective equipment and/or other products.

It is to be understood that the disclosure is not to be limited to the specific examples disclosed, and that modifications and other examples are intended to be included within the scope of the appended claims. Although specific terms are employed herein, they are used in a generic and descriptive sense only and not for purposes of limitation, unless described otherwise.

The invention claimed is:

1. A mask comprising:

an exterior layer defining an exterior layer breathable area, the exterior layer including an attachment mechanism having an elastic band extending across a portion of the exterior layer to define a pocket between the elastic band and a surface of the exterior layer;

one or more mask straps coupled to the exterior layer; and a filter layer defining a filter layer breathable area, wherein the filter layer is configured to removably couple to the exterior layer by positioning a portion of the filter layer in the pocket between the elastic band and the surface of the exterior layer.

2. The mask of claim 1, wherein the exterior layer defines one or more attachment mechanisms configured to hold the filter layer in connection with the exterior layer.

3. The mask of claim 1, wherein the exterior layer breathable area and the filter layer breathable area are configured to at least partially overlap in an instance in which the filter layer is coupled to the exterior layer.

4. The mask of claim 1, wherein the filter layer breathable area is configured to be positioned on a mouth region of a user in an instance the user is wearing the mask.

5. The mask of claim 1, wherein at least one of the one or more mask straps is adjustable.

6. The mask of claim 1, wherein the one or more mask straps comprise a first ear strap and a second ear strap, wherein the first ear strap is attached to the exterior layer at one end of the exterior layer and the second ear strap is attached to the exterior layer at an opposite end of the exterior layer.

7. The mask of claim 1, wherein the exterior layer comprises a 3-dimensional (3D) knitted, antimicrobial material.

8. The mask of claim 1, wherein the filter layer is replaceable.

9. The mask of claim 1, wherein the exterior layer comprises a nose clip integral to the exterior layer, wherein the nose clip is adjustable.

* * * * *